US012365555B2

(12) United States Patent
Niwata et al.

(10) Patent No.: US 12,365,555 B2
(45) Date of Patent: Jul. 22, 2025

(54) MEDIUM FEED APPARATUS TO PUT SEPARATION ROLLER ON HOLD UNTIL FRONT END OF MEDIUM PASSES SEPARATION PART

(71) Applicant: PFU LIMITED, Kahoku (JP)

(72) Inventors: Tomoyuki Niwata, Kahoku (JP); Shota Otsuka, Kahoku (JP)

(73) Assignee: PFU LIMITED, Kahoku (JP)

( * ) Notice: Subject to any disclaimer, the term of this patent is extended or adjusted under 35 U.S.C. 154(b) by 205 days.

(21) Appl. No.: 18/352,735

(22) Filed: Jul. 14, 2023

(65) Prior Publication Data

US 2024/0067471 A1 Feb. 29, 2024

(30) Foreign Application Priority Data

Aug. 24, 2022 (JP) ..... 2022-133667

(51) Int. Cl.

| | |
|---|---|
| ***B65H 7/18*** | (2006.01) |
| ***B65H 3/06*** | (2006.01) |
| ***B65H 3/52*** | (2006.01) |
| ***B65H 7/02*** | (2006.01) |
| ***B65H 7/06*** | (2006.01) |

(52) U.S. Cl.

CPC ..... *B65H 7/18* (2013.01); *B65H 3/0669* (2013.01); *B65H 3/0684* (2013.01); *B65H 3/5261* (2013.01); *B65H 7/02* (2013.01); *B65H 7/06* (2013.01); *B65H 2511/11* (2013.01); *B65H 2513/50* (2013.01); *B65H 2701/1311* (2013.01); *B65H 2701/1313* (2013.01)

(58) Field of Classification Search

CPC ..... B65H 3/06; B65H 3/0669; B65H 3/0684; B65H 3/5261; B65H 7/02; B65H 7/06; B65H 7/08; B65H 7/14; B65H 7/18; B65H 2511/11; B65H 2513/50; B65H 2553/51; B65H 2701/1311; B65H 2701/1313

See application file for complete search history.

(56) References Cited

U.S. PATENT DOCUMENTS

| | | | | |
|---|---|---|---|---|
| 2007/0126171 | A1* | 6/2007 | Takeuchi | B65H 3/5261 271/121 |
| 2008/0290584 | A1* | 11/2008 | Dunn | B65H 7/06 271/10.02 |
| 2017/0166411 | A1 | 6/2017 | Kawarago et al. | |
| 2021/0292116 | A1* | 9/2021 | Takayama | B65H 3/0669 |

FOREIGN PATENT DOCUMENTS

| | | |
|---|---|---|
| JP | 2017-105602 A | 6/2017 |

* cited by examiner

*Primary Examiner* — Prasad V Gokhale
(74) *Attorney, Agent, or Firm* — WOMBLE BOND DICKINSON (US) LLP

(57) ABSTRACT

A medium feed apparatus includes a first sensor, a second sensor, a third sensor to detect rotation of the separation roller, and a processor. The processor controls a motor to put the separation roller on hold from when starting the feed of the medium to when the second sensor detects a front end of the medium and generate the drive force from when the second sensor detects the front end of the medium to when the first sensor detects a back end of the medium, and controls the motor to stop the feed roller while generating the drive force if the third sensor detects rotation of the separation roller in the opposite direction to the medium feed direction during feed of the medium.

20 Claims, 12 Drawing Sheets

MEDIUM FEED APPARATUS TO PUT SEPARATION ROLLER ON HOLD UNTIL FRONT END OF MEDIUM PASSES SEPARATION PART

CROSS-REFERENCE TO RELATED APPLICATIONS

This application is based upon and claims the benefit of priority of prior Japanese Patent Application No. 2022-133667, filed on Aug. 24, 2023, the entire contents of which are incorporated herein by reference.

TECHNICAL FIELD

Embodiments discussed in the present specification relate to feed a medium.

BACKGROUND

A scanner or other medium feed apparatus feeds and captures images of a plurality of sheets of a medium while separating them into individual sheets. If multi-feed of the medium occurs in such a medium feed apparatus, the user has to take out the medium from inside the housing and reset it on the stacking tray. In order to improve the user friendliness, it is desirable to reduce the possibility of multi-feed of the medium occurring.

A feed apparatus, in which the rotational speed of a retard roller is detected and a feeding means is controlled to continue the feed operation of a recording material if the rotational speed is a first value or more and stop the feed operation if it is less than the first value, has been disclosed.

SUMMARY

According to some embodiments, a medium feed apparatus includes a feed roller to feed a medium, a separation roller located facing the feed roller, a motor configured to generate a drive force for rotating the separation roller in an opposite direction to a medium feed direction, a first sensor located at an upstream side from the feed roller and separation roller in a medium conveyance direction, a second sensor located at a downstream side from the feed roller and separation roller in the medium conveyance direction, a third sensor configured to detect rotation of the separation roller, and a processor to rotate the feed roller in the medium feed direction to feed the medium. The processor controls the motor so as to put the separation roller on hold from when starting the feed of the medium to when the second sensor detects a front end of the medium and generate the drive force from when the second sensor detects the front end of the medium to when the first sensor detects a back end of the medium, and controls the motor to stop the feed roller while generating the drive force if the third sensor detects rotation of the separation roller in the opposite direction to the medium feed direction during feed of the medium.

According to some embodiments, a medium feed method includes rotating a feed roller in a medium feed direction to feed a medium, controlling a motor to put a separation roller located facing the feed roller on hold from when starting the feed of the medium to when a second sensor located at a downstream side from the feed roller and separation roller in a medium conveyance direction detects a front end of the medium and generate a drive force for rotating the separation roller in an opposite direction to the medium feed direction from when the second sensor detects the front end of the medium to when a first sensor located at an upstream side from the feed roller and separation roller in the medium conveyance direction detects a back end of the medium, and controlling the motor to stop the feed roller while generating the drive force if a third sensor detects rotation of the separation roller in the opposite direction to the medium feed direction during feed of the medium.

According to some embodiments, a computer-readable, non-transitory medium stores executable instructions for feeding a medium. The executable instructions include rotating a feed roller in a medium feed direction to feed the medium, controlling a motor to put a separation roller located facing the feed roller on hold from when starting the feed of the medium to when a second sensor located at a downstream side from the feed roller and separation roller in a medium conveyance direction detects a front end of the medium and generate a drive force for rotating the separation roller in an opposite direction to the medium feed direction from when the second sensor detects the front end of the medium to when a first sensor located at an upstream side from the feed roller and separation roller in the medium conveyance direction detects a back end of the medium, and controlling the motor to stop the feed roller while generating the drive force if a third sensor detects rotation of the separation roller in the opposite direction to the medium feed direction during feed of the medium.

DESCRIPTION OF EMBODIMENTS

It is to be understood that both the foregoing general description and the following detailed description are exemplary and explanatory, and are not restrictive of the invention, as claimed.

Hereinafter, a medium feed apparatus, medium feed method and computer-readable, non-transitory medium according to an embodiment, will be described with reference to the drawings. However, it should be noted that the technical scope of the invention is not limited to these embodiments, and extends to the inventions described in the claims and their equivalents.

Figure 1:
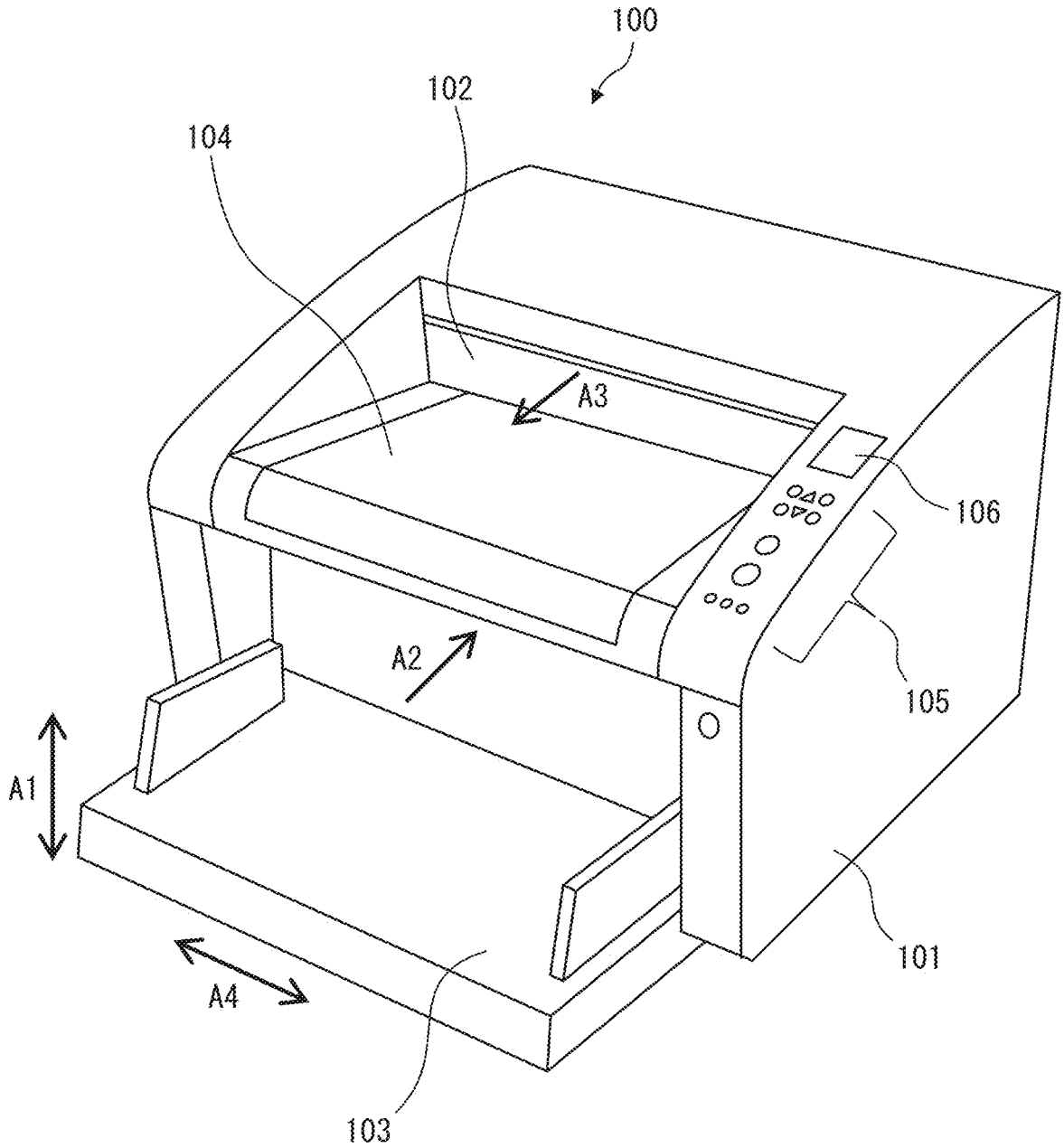
FIG. 1 is a perspective view illustrating an example of a medium feed apparatus.

FIG. 1 is a perspective view illustrating an example of a medium feed apparatus constituted as an image scanner. The medium feed apparatus 100 conveys a document as a medium and captures an image of it. The medium is printing paper, thick paper, a card, etc. The medium feed apparatus 100 may be a facsimile, copier, multifunction peripheral (MFP), etc. In FIG. 1, the arrow A1 indicates a substantially vertical direction (height direction), the arrow A2 indicates a medium conveyance direction, the A3 indicates a medium ejection direction, and the arrow A4 indicates a width direction perpendicular to the medium conveyance direction A2 or the medium ejection direction A3. Below, "upstream" means upstream in the medium conveyance direction A2 or medium ejection direction A3, while "downstream" means downstream in the medium conveyance direction A2 or medium ejection direction A3.

The medium feed apparatus 100 is provided with a first housing 101, second housing 102, stacking tray 103, ejection tray 104, operating device 105, display device 106, etc.

The second housing 102 is located at the inside of the first housing 101 and engaged with the first housing rotatably by a hinge to enable it to be opened and closed at the time of jamming of the medium or the time of cleaning the inside of the medium feed apparatus 100, etc.

The stacking tray 103 engages with the first housing 101 to be able to stack the medium to be conveyed. The stacking tray 103 is provided at the side surface of the first housing 101 at the medium supply side movably in the height direction A1. When not conveying the medium, the stacking tray 103 is located at the bottom end so that the medium is easily stacked. When conveying the medium, the stacking tray 103 is raised to the position where a later explained pick roller contacts the media stacked on the top.

The ejection tray 104 is formed on the second housing 102. The ejection tray 104 has a stacking surface 104*a* for stacking the medium and stacks the medium ejected from an ejection opening of the first housing 101 and the second housing 102.

The operating device 105 has buttons or other input devices and an interface circuit acquiring signals from the input devices, receiving input operations of a user, and outputting operating signals corresponding to the input operations of a user. The display device 106 has a display including liquid crystals, organic Electro-Luminescence (El), etc., and an interface circuit outputting image data to the display and displaying the image data on the display. Note that the display device 106 may be a liquid crystal display with a touch panel function. In that case, the operating device 105 has an interface circuit for acquiring input signals from the touch panel.

Figure 2:
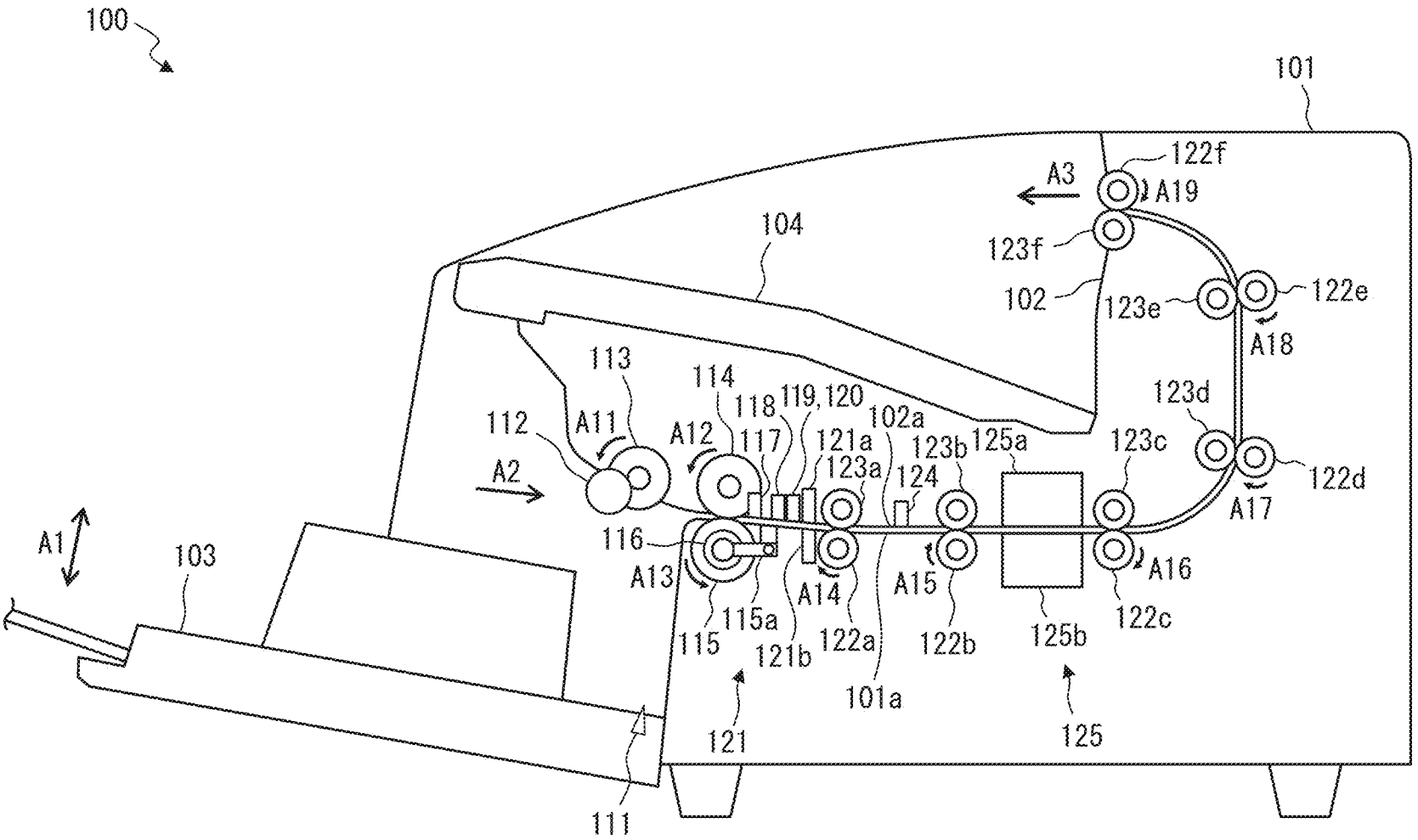
FIG. 2 is a view for explaining an example of conveyance path inside of an example of a medium feed apparatus.

FIG. 2 is a view for explaining an example of a conveyance path inside of an example of a medium feed apparatus.

The conveyance path inside of the medium feed apparatus 100 has a first medium sensor 111, first encoder 112, pick roller 113, feed roller 114, separation roller 115, second encoder 116, second medium sensor 117, third medium sensor 118, first skew sensor 119, second skew sensor 120, ultrasonic sensor 121, first to sixth conveyance rollers 122*a* to 122*f*, first to sixth driven rollers 123*a* to 123*f*, a fourth medium sensor 124, imaging device 125, etc.

Note that, the numbers of the pick roller 113, feed roller 114, separation roller 115, first to sixth conveyance rollers 122*a* to 122*f*, and/or first to sixth driven rollers 123*a* to 123*f* are not limited to one and may be plural. In this case, the plurality of feed rollers 114, separation rollers 115, first to sixth conveyance rollers 122*a* to 122*f*, and/or first to sixth driven rollers 123*a* to 123*f* are located in the width direction A4.

The second housing 102 is located facing the first housing 101 with the medium conveyance path therebetween. The surface of the first housing 101 facing the second housing 102 forms a first guide 101*a* of the medium conveyance path, while the surface of the second housing 102 facing the first housing 101 forms a second guide 102*a* of the medium conveyance path.

The first medium sensor 111 is located at the stacking tray 103, i.e., at an upstream side from the feed roller 114 and separation roller 115, and detects the stacking state of the medium at the stacking tray 103. The first medium sensor 111 determines whether the stacking tray 103 has the medium by a contact detection sensor which generates a predetermined current when the medium contacts or when the medium does not contact. The first medium sensor 111 generates and outputs a first medium signal with a signal value changing between a state where the stacking tray 103 has the medium and a state where the stacking tray 103 does not have the medium. Note that the first medium sensor 111 is not limited to a contact detection sensor. A photo detection sensor or any other sensor able to detect the presence of the medium may be used as the first medium sensor 111.

The first encoder 112 is an example of a first sensor. The first encoder 112 is located at the second housing 102 at an upstream side from the feed roller 114 and separation roller 115 in the medium conveyance direction A2 and detects a back end of the medium being fed by contacting and detecting the movement of the medium. In particular, the first encoder 112 is located at an upstream side from the pick roller 113 in the medium conveyance direction A2, in particular in the vicinity of the pick roller 113. The first encoder 112 has a disk formed with a large number of slits (openings for passing light) and provided so as to rotate in accordance with the medium being fed, and a light emitter and light receiver provided so as to face each other with the disk in between. The light emitter is an LED (light emitting diode), etc., and emits light toward the disk (light receiver). The light receiver is a photodiode, etc., and receives light emitted from the light emitter through the disk. The light receiver detects the number of changes within a predetermined time period from a state where there is a slit between the light emitter and light receiver to a state where there is no slit and light is blocked by the disk. The light receiver multiplies the detected number of changes with a distance of movement of the outer circumferential surface of the first encoder 112 when the disk rotates by the distance between two mutually adjoining slits to detect the distance of movement of the medium being fed. The first encoder 112 generates and outputs a distance signal indicating the distance of movement detected. When the back end of the medium being fed passes the position of the first encoder 112, the distance of movement of the medium changes from a value larger than 0 to 0, so the first encoder 112 can detect the back end of the medium from the distance of movement of the medium. Note that, the first encoder 112 is not limited to an optical type encoder and may be a mechanical type encoder, magnetic type encoder, electromagnetic induction type encoder, or any other encoder.

The pick roller 113 is located at the second housing 102 at the upstream side from the feed roller 114 and separation roller 115 in the medium conveyance direction A2. The pick roller 113 contacts the sheet at the topmost side in the medium stacked on the stacking tray 103 when the stacking tray 103 has risen to substantially the same height as the medium conveyance path and conveys the sheet of the medium toward the downstream side. A one-way clutch is provided between the pick roller 113 and the motor imparting a drive force to the pick roller 113, so that the rotation of the pick roller 113 in the opposite direction to the medium feed direction A11 is restricted.

The feed roller 114 is provided inside the second housing 102 at the downstream side from the pick roller 113 and feeds the medium stacked on the stacking tray 103 and fed by the pick roller 112 toward the further downstream side. If a plurality of feed rollers 114 are provided, the individual feed rollers 114 are provided to rotate independently by separate motors. The feed rollers 114 may be provided so as to rotate integrally by a common motor. A one-way clutch is provided between each feed roller 114 and the motor imparting drive force to the feed roller 114, so that the rotation of the feed roller 114 in a direction opposite to the medium feed direction A12 is restricted.

The separation roller 115 is located inside the first housing 101 facing the feed roller 114. The separation roller 115 is a so-called brake roller or retard roller and is provided rotatably in an direction A13 opposite to the medium feed direction or to be stoppable. The feed roller 114 and separation roller 115 function as a separation part for separating and feeding the medium one by one. The feed roller 114 is located above the separation roller 115, and the medium feed apparatus 100 feeds the medium by the so-called top pick method. Note that the feed roller 114 may be located below the separation roller 115, and the medium feed apparatus 100 may feed the medium by the so-called bottom pick method.

A torque limiter is provided between the separation roller 115 and the motor imparting drive force to the separation roller 115 for limiting the torque acting on the separation roller 115. The limit value of the torque limiter is set to a value such that the rotational force through the torque limiter is cut when there is a single sheet of the medium, and transmitted when there are a plurality of sheets of the medium. Therefore, if just one sheet of the medium is being conveyed, the separation roller 115 does not rotate with the drive force from the motor, but is driven by the feed roller 114. On the other hand, if a plurality of sheets of the medium are being conveyed, the separation roller 115 rotates in the direction A13 opposite to the medium feed direction to separate the sheet of the medium contacting the feed roller 114 from other sheets of the medium and prevent the occurrence of multi-feed. At this time, the outer circumferential surface of the separation roller 115 may apply force in direction A13 opposite to the medium feed direction to the medium by stopping without rotating in the opposite direction A13 of the medium feed direction.

The separation roller 115 is supported by an arm 115*a* at the first housing 101. The separation roller 115 is attached to one end of the arm 115*a*. The other end of the arm 115*a* is attached to the first housing 101. The arm 115*a* is provided rotatably (swingably) at the first housing 101. The arm 115*a* is given a biasing force upward, i.e., in a direction where the separation roller 115 moves toward the feed roller 114 side, by a spring member or rubber member or other biasing member. Further, a rotational force is applied to the arm 115*a* by the drive force from a motor. The medium feed apparatus 100 adjusts the pressing force with which the separation roller 115 presses against the feed roller 114 by rotating (swinging) the arm 115*a*.

The second encoder 116 is one example of a third sensor. The second encoder 116 is attached to a shaft of the rotational axis of the separation roller 115 in the second housing 102 and detects rotation of the separation roller 115. The second encoder 116 has a disk formed with a large number of slits (openings for passing light) and provided so as to rotate along with rotation of the separation roller 115 and a light emitter and light receiver provided so as to face each other with the disk in between. The light emitter is an LED, etc., and emits light toward the disk (light receiver). The light receiver is a photodiode, etc., and receives light emitted by the light emitter through the disk. The light receiver detects the number of changes within a predetermined time period from a state where there is there a slit between the light emitter and the light receiver to a state where there is no slit there and light is blocked by the disk. The light receiver multiplies the detected number of changes with the distance by which the outer circumferential surface of the separation roller 115 moves when the disk rotates by the distance between two mutually adjoining slits to detect the distance of movement of the outer circumferential surface of the separation roller 115. Further, a fixed slit is provided between the light emitter and the light receiver so that the output signal (pulse) becomes biphasic. The light receiver detects the direction of rotation of the disk by the rising timings of the output signals of the phases. The second encoder 116 generates and outputs a rotation signal indicating the detected distance of movement and rotational direction of the disk (stop/forward direction/backward direction). Note that, the second encoder 116 is not limited to an optical type encoder and may be a mechanical type encoder, magnetic type encoder, electromagnetic induction type encoder, or any other encoder.

The second medium sensor 117 is one example of a second sensor. The second medium sensor 117 is located at a downstream side from the feed roller 114 and separation roller 115 and the upstream side from the first conveyance roller 122*a* and the first driven roller 123*a* in the medium conveyance direction A2, and detects a medium. In particular, the second medium sensor 117 is located in the vicinity of the feed roller 114 and separation roller 115. The second medium sensor 117 includes a light emitter and a light receiver provided at one side of the medium conveyance path and a light guide provided at a position facing the light emitter and the light receiver with the medium conveyance path therebetween. The light emitter is an LED, etc., and emits light toward the medium conveyance path. The light receiver is a photodiode, etc., and receives light emitted by the light emitter and guided by the light guide. Based on the intensity of the light received by the light receiver, the second medium sensor 117 generates and outputs a second medium signal with a signal value changing between the state where there is the medium at the position of the second medium sensor 117 and the state where there is no medium.

The third medium sensor 118 is one example of a fourth sensor. The third medium sensor 118 is located at a downstream side from the feed roller 114 and separation roller 115 and the upstream side from the first conveyance roller 122*a* and the first driven roller 123*a* in the medium conveyance direction A2, and detects a medium. In other words, the third medium sensor 118 is located between the feed roller 114 and separation roller 115 and the first conveyance roller 122*a* and the first driven roller 123*a* in the medium conveyance direction A2. In particular, the third medium sensor 118 is located at the downstream side from the second medium sensor 117 in the medium conveyance direction A2. The third medium sensor 118 includes a light emitter and a light receiver provided at one side of the medium conveyance path and a light guide provided at a position facing the light emitter and the light receiver with the medium conveyance path therebetween. The light emitter is an LED, etc., and emits light toward the medium conveyance path. The light receiver is a photodiode, etc., and receives light emitted by the light emitter and guided by the light guide. Based on the intensity of the light received by the light receiver, the third medium sensor 118 generates and outputs a third medium signal with a signal value changing between the state where there is the medium at the position of the third medium sensor 118 and the state where there is no medium.

The first skew sensor 119 and the second skew sensor 120 are located at a downstream side from the feed roller 114 and separation roller 115 and the upstream side from the first conveyance roller 122*a* and the first driven roller 123*a* in the medium conveyance direction A2, and detect a medium. In particular, the first skew sensor 119 and the second skew sensor 120 are located at a downstream side from the third medium sensor 118 in the medium conveyance direction A2. The first skew sensor 119 and the second skew sensor 120 may be located at an upstream side from the third medium sensor 118 in the medium conveyance direction A2. The first skew sensor 119 and the second skew sensor 120 are located at the same position in the medium conveyance direction A2 and aligned spaced apart in the width direction A4.

The first skew sensor 119 includes a light emitter and a light receiver provided at one side of the medium conveyance path and a light guide provided at a position facing the light emitter and the light receiver with the medium conveyance path therebetween. The light emitter is an LED, etc., and emits light toward the medium conveyance path. The light receiver is a photodiode, etc., and receives light emitted by the light emitter and guided by the light guide. Based on the intensity of the light received by the light receiver, the first skew sensor 119 generates and outputs a first skew signal with a signal value changing between the state where there is the medium at the position of the first skew sensor 119 and the state where there is no medium.

The second skew sensor 120 includes a light emitter and a light receiver provided at one side of the medium conveyance path and a light guide provided at a position facing the light emitter and the light receiver with the medium conveyance path therebetween. The light emitter is an LED, etc., and emits light toward the medium conveyance path. The light receiver is a photodiode, etc., and receives light emitted by the light emitter and guided by the light guide. Based on the intensity of the light received by the light receiver, the second skew sensor 120 generates and outputs a second skew signal with a signal value changing between the state where there is the medium at the position of the second skew sensor 120 and the state where there is no medium.

The ultrasonic sensor 121 is located at the downstream side from the feed roller 114 and separation roller 115 and the upstream side from the first conveyance roller 122*a* and the first driven roller 123*a*. The ultrasonic sensor 121 may be located at the downstream side from the first conveyance roller 122*a* and the first driven roller 123*a*. The ultrasonic sensor 121 includes an ultrasonic wave transmitter 121*a* and ultrasonic wave receiver 121*b* located in the vicinity of the medium conveyance path facing each other with the medium conveyance path therebetween. The ultrasonic wave transmitter 121*a* transmits an ultrasonic wave. The ultrasonic wave receiver 121*b* receives the ultrasonic wave transmitted by the ultrasonic wave transmitter 121*a* and passing through the medium and generates and outputs an electrical signal corresponding to the received ultrasonic wave as an ultrasonic wave signal. The ultrasonic wave signal indicates the magnitude of the ultrasonic wave passing through the medium being fed.

The first to sixth conveyance rollers 122*a* to 122*f* and the first to sixth driven rollers 123*a* to 123*f* are located facing each other at the downstream side from the feed roller 114 and separation roller 115 in the medium conveyance direction A2. The first to sixth conveyance rollers 122*a* to 122*f* and the first to sixth driven rollers 123*a* to 123*f* convey the medium fed by the feed roller 114 and separation roller 115 toward the downstream side. The sixth conveyance roller 122*f* and sixth driven roller 123*f* eject the medium to the ejection tray 104.

The fourth medium sensor 124 is located at the downstream side from the first conveyance roller 122*a* and the first driven roller 123*a* and the upstream side from the second conveyance roller 122*b* and second driven rollers 123*b* in the medium conveyance direction A2, and detects the medium. The fourth medium sensor 124 may be located at the downstream side from the second conveyance roller 122*b* and the second driven roller 123*b* in the medium conveyance direction A2 and the upstream side from the imaging device 125. The fourth medium sensor 124 includes a light emitter and a light receiver provided at one side of the medium conveyance path and a light guide provided at a position facing the light emitter and the light receiver with the medium conveyance path therebetween. The light emitter is an LED, etc., and emits light toward the medium conveyance path. The light receiver is a photodiode, etc., and receives light emitted by the light emitter and guided by the light guide. Based on the intensity of the light received by the light receiver, the fourth medium sensor 124 generates and outputs a fourth medium signal with a signal value changing between the state where there is the medium at the position of the fourth medium sensor 124 and the state where there is no medium.

Note that, in the second medium sensor 117, third medium sensor 118, first skew sensor 119, second skew sensor 120, and/or fourth medium sensor 124, instead of a light guide, a minor or other reflection member may be used. Further, the light emitter and light receiver may be provided facing each other with the medium conveyance path therebetween. Further, the sensors may detect the presence of a medium by a contact detection sensor, etc., which runs a predetermined current when the medium is contacted or when the medium is not contacted.

The imaging device 125 is located at a downstream side from the first and the second conveyance rollers 122*a* and 122*b* in the medium conveyance direction A2 and captures the medium conveyed by the first and the second conveyance rollers 122*a* and 122*b* and the first and second driven rollers 123*a* and 123*b*. The imaging device 125 includes a first imaging device 125*a* and second imaging device 125*b* located facing each other with the medium conveyance path therebetween. The first imaging device 125*a* is provided at the second housing 102, while the second imaging device 125*b* is provided at the first housing 101.

The first imaging device 125*a* includes a line sensor based on a unity-magnification optical system type Contact Image Sensor (CIS) including an imaging element based on a Complementary Metal Oxide Semiconductor (CMOS) linearly located in a main scanning direction. Further, the first imaging device 125*a* includes a lens for forming an image on the imaging element, and an Analog-to-Digital (A/D) converter for amplifying and analog-digital converting an electric signal output from the imaging element. The first imaging device 125*a* captures an image of the front surface of the conveyed medium to generate and output an input image.

Similarly, the second imaging device 125*b* includes a line sensor based on a unity-magnification optical system type CIS including an imaging element based on a CMOS linearly located in a main scanning direction. The second imaging device 125*b* includes a lens for forming an image on the imaging element, and an A/D converter for amplifying and analog-digital converting an electric signal output from the imaging element.

Note that, the medium feed apparatus 100 may have only one of the first imaging device 125*a* and the second imaging device 125*b* and read only one surface of the medium. Further, a line sensor based on a unity-magnification optical system type CIS including an imaging element based on Charge Coupled Devices (CCDs) may be used in place of the line sensor based on a unity-magnification optical system type CIS including an imaging element based on a CMOS. Further, a line sensor based on a reduction optical system type line sensor including an imaging element based on CMOS or CCDs may be used.

The medium stacked on the stacking tray 103 is conveyed between the first guide 101*a* and the second guide 102*a* toward the medium conveyance direction A2 by the pick roller 113 and the feed roller 114 respectively rotating in the medium feed directions A11, A12. The medium feed apparatus 100 has a separation mode in which the medium is fed while separating and a nonseparation mode in which the medium is fed without separating as feed modes. The feed mode is set by the user using the operating device 105 or an information processing apparatus coupled to the medium feed apparatus 100 to communicate with it. If the feed mode is set to the separation mode, the separation roller 115 rotates in the direction of the arrow A13, i.e., the direction opposite to the medium feed direction, or stops. Therefore, feed of the medium other than the separated medium is restricted (multi-feed is prevented). On the other hand, if the feed mode is set to the nonseparation mode, the separation roller 115 rotates in the opposite direction to the arrow A13, i.e., in the medium feed direction.

The medium is sent to the imaging position of the imaging device 125 by being guided by the first guide 101*a* and the second guide 102*a* while the first and second conveyance rollers 122*a* and 122*b* rotate in the directions of the arrows A14 and A15 and is captured by the imaging device 125. Furthermore, the medium is ejected onto the ejection tray 104 by the third to the sixth conveyance rollers 122*c* to 122*f* respectively rotating in the directions of the arrows A16 to A19.

Figure 3A:
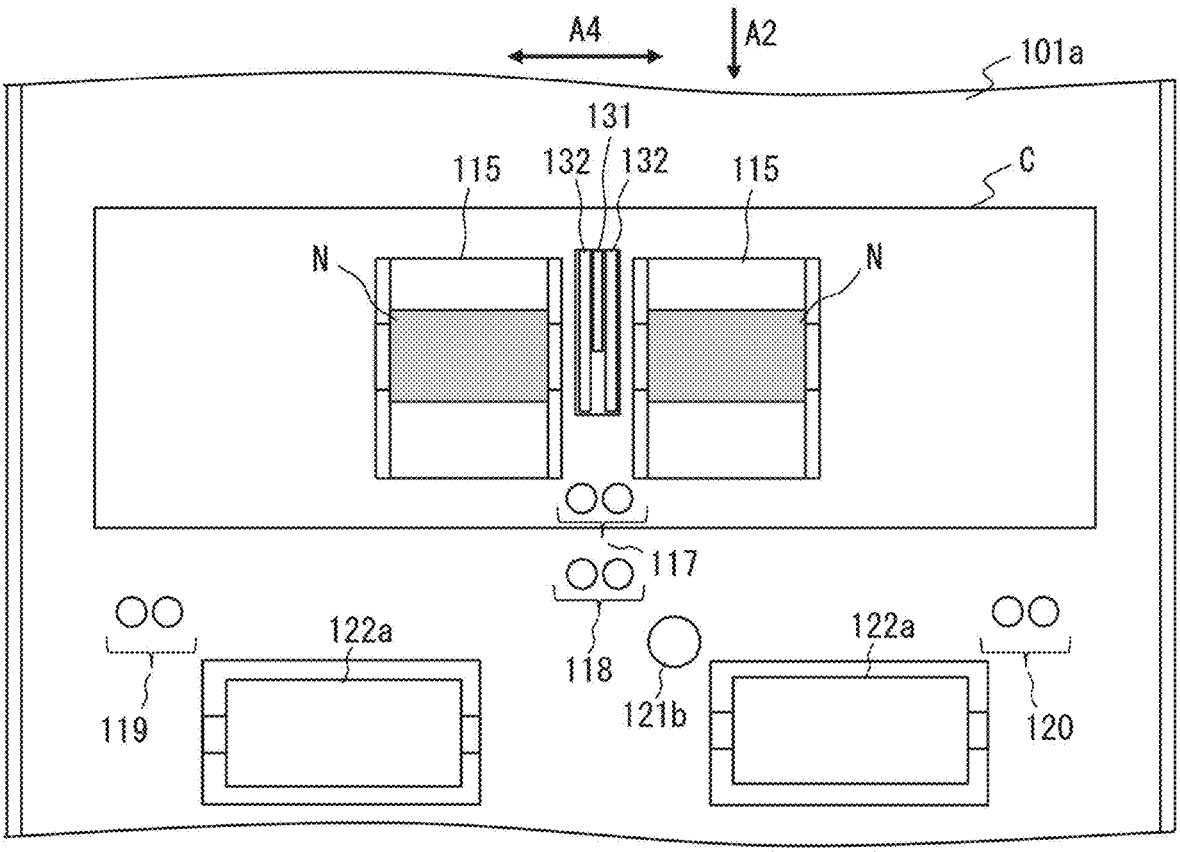
FIG. 3A is a schematic view for explaining an example of a first arm and an example of second arm.
Figure 3B:
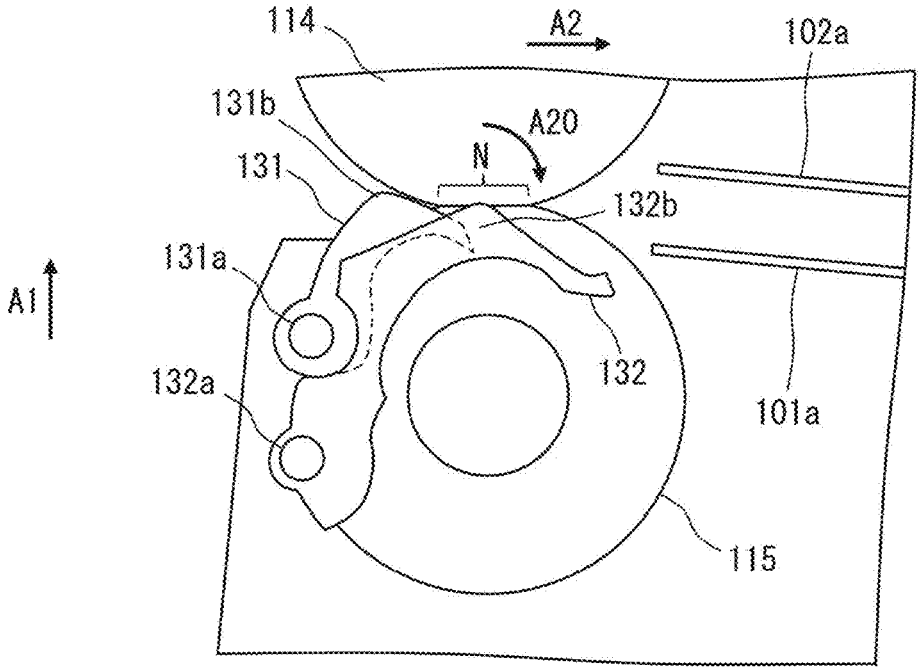
FIG. 3B is a schematic view for explaining an example of a first arm and an example of a second arm.

FIGS. 3A and 3B are schematic views for explaining an example of a first arm and an example of a second arm. FIG. 3A illustrates a schematic view seen from above of the surroundings of the separation roller 115 of the first housing 101 in the state with the second housing 102 opened, while FIG. 3B illustrates a schematic view seen from the side of the surroundings of the feed roller 114 and the separation roller 115.

As illustrated in FIGS. 3A and 3B, the medium feed apparatus 100 has the first arm 131 and second arm 132. In the example illustrated in FIGS. 3A and 3B, a plurality of separation rollers 115 are located spaced apart in the width direction A4 perpendicular to the medium conveyance direction. In this case, a plurality of feed rollers 114 are located spaced apart in the width direction A4 perpendicular to the medium conveyance direction to face the separation rollers 115.

The first arm 131 is a plate-shaped member extending along the medium conveyance direction A2 and is provided swingably (rotatably) in the height direction A1 about an upstream side end part 131*a* at the first housing 101. The first arm 131 is located between the plurality of separation rollers 115 in the width direction A4 perpendicular to the medium conveyance direction. The first arm 131 has a first projecting part 131*b*. The first projecting part 131*b* is provided swingably so as to project out from the first guide 101*a*, i.e., the guide surface of the medium, and is located at an upstream side from nip parts N of the feed rollers 114 and the separation rollers 115 in the medium conveyance direction A2 in the state projecting out from the first guide 101*a*.

The second arm 132 is a plate-shaped member extending along the medium conveyance direction A2 and is provided swingably (rotatably) in the height direction A1 about an upstream side end part 132*a*. The second arm 132 is located between the plurality of separation rollers 115 in the width direction A4 perpendicular to the medium conveyance direction. A gap is provided at the center part of the second arm 132 in the width direction A4. The first arm 131 is located at the center part (gap) of the second arm 132 in the width direction A4. The second arm 132 has a second projecting part 132*b*. The second projecting part 132*b* is provided swingably so as to project out from the first guide 101*a*, i.e., the guide surface of the medium, and is located so as to overlap the nip parts N of the feed rollers 114 and the separation rollers 115 in the medium conveyance direction A2 in the state projecting out from the first guide 101*a*. In other words, the second projecting part 132*b* is located at the downstream side from the first projecting part 131*b* in the medium conveyance direction A2.

If the medium is returned from the downstream side toward the upstream side, that medium is subjected to the pressing force from the pick roller 113 and the feed roller 114. For this reason, there is a possibility of the medium buckling between the pick roller 113 and the feed roller 114 and the possibility of the separation roller 115 slipping and the medium jamming. As opposed to this, the first projecting part 131*b* and the second projecting part 132*b* push the medium being fed upward at the center of the width direction A4. The medium being fed bends in a wavy manner in the width direction A4, so the medium feed apparatus 100 can stiffen the medium and can improve the rigidity of the medium moving along the medium conveyance direction A2.

For this reason, even if returning a thin medium with weak stiffness from the downstream side toward the upstream side, the medium feed apparatus 100 can keep the medium from buckling and jamming. Further, even when a medium includes several sheets of paper such as an envelope or carbon paper are returned from the downstream side toward the upstream side, the medium feed apparatus 100 can keep the medium from jamming since the medium has stiffened enough to withstand separation force from the separation roller 115. In particular, the medium feed apparatus 100 uses the first projecting part 131*b* and the second projecting part 132*b* located at mutually different positions in the medium conveyance direction A2 to stiffen the medium in two stages. Therefore, the medium has higher stiffness, so the medium feed apparatus 100 can keep the medium from buckling or jamming.

Figure 4:
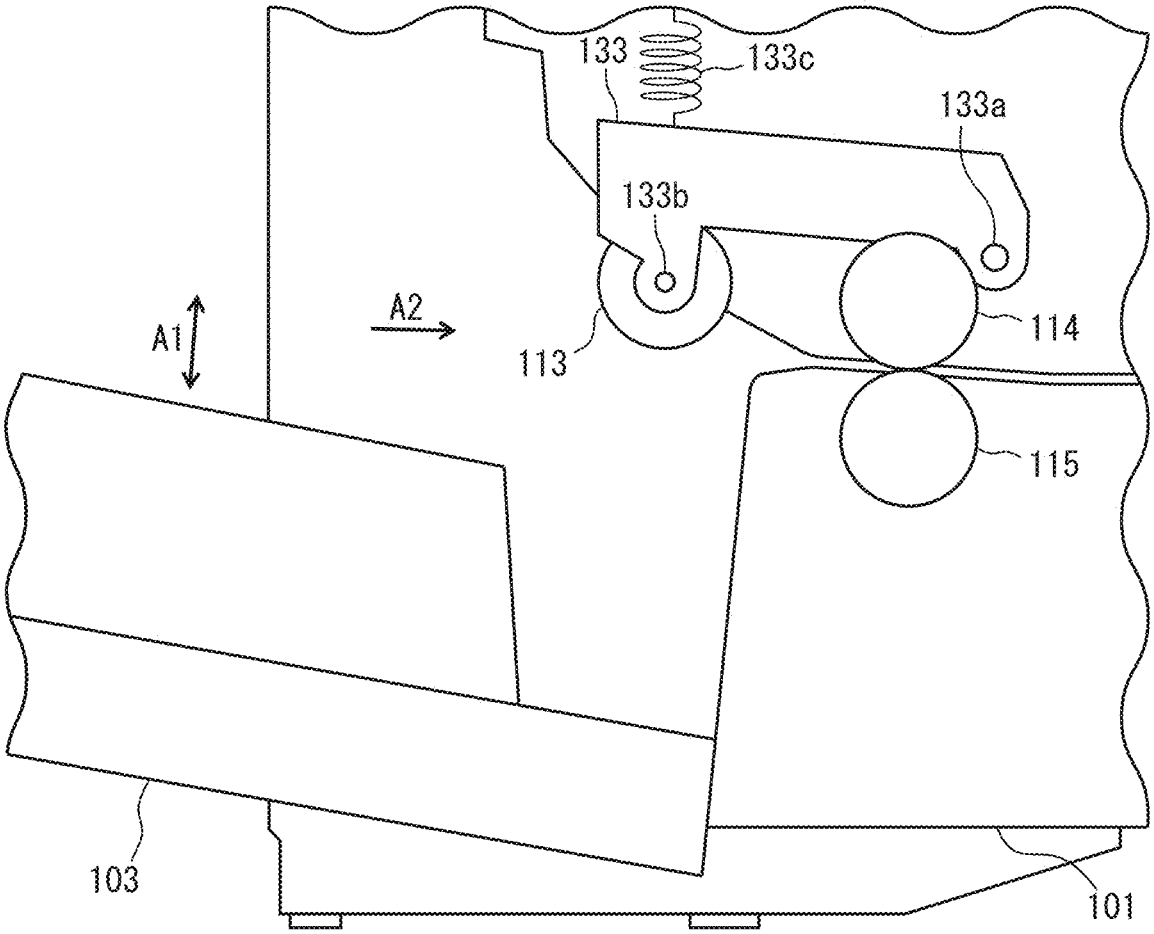
FIG. 4 is a schematic view for explaining an example of a pick roller.

FIG. 4 is a schematic view for explaining an example of a pick roller.

As illustrated in FIG. 4, the medium feed apparatus 100 has an arm 133 supporting the pick roller 113. The arm 133 extends along the medium conveyance direction A2 and is provided at the second housing 102 rotatably (swingably) about the downstream side end part 133*a*. The pick roller 113 is attached to the upstream side end part 133*b* of the arm 133. A biasing member 133*c* is attached above the arm 133. The biasing member 133*c* is a torsion coil spring or other spring member or a rubber member, etc., and imparts downward biasing force to the arm 133. Note that, the biasing member 133*c* may be omitted and the arm 133 is given only a downward force by its own weight. By the arm 133 being biased downward, the pick roller 113 can press the medium stacked on the stacking tray 103 downward while suitably conveying the medium.

Further, the arm 133 is given a rotational force to swing (rotate) upward by the drive force from a motor. By rotating (swinging) the arm 133, the medium feed apparatus 100 can move the pick roller 113 between a first position where the pick roller 113 contacts the medium stacked on the stacking tray 103 and a second position where the pick roller 113 moves away from the medium stacked on the stacking tray 103. In this way, the pick roller 113 can move between the first position and second position.

Figure 5:
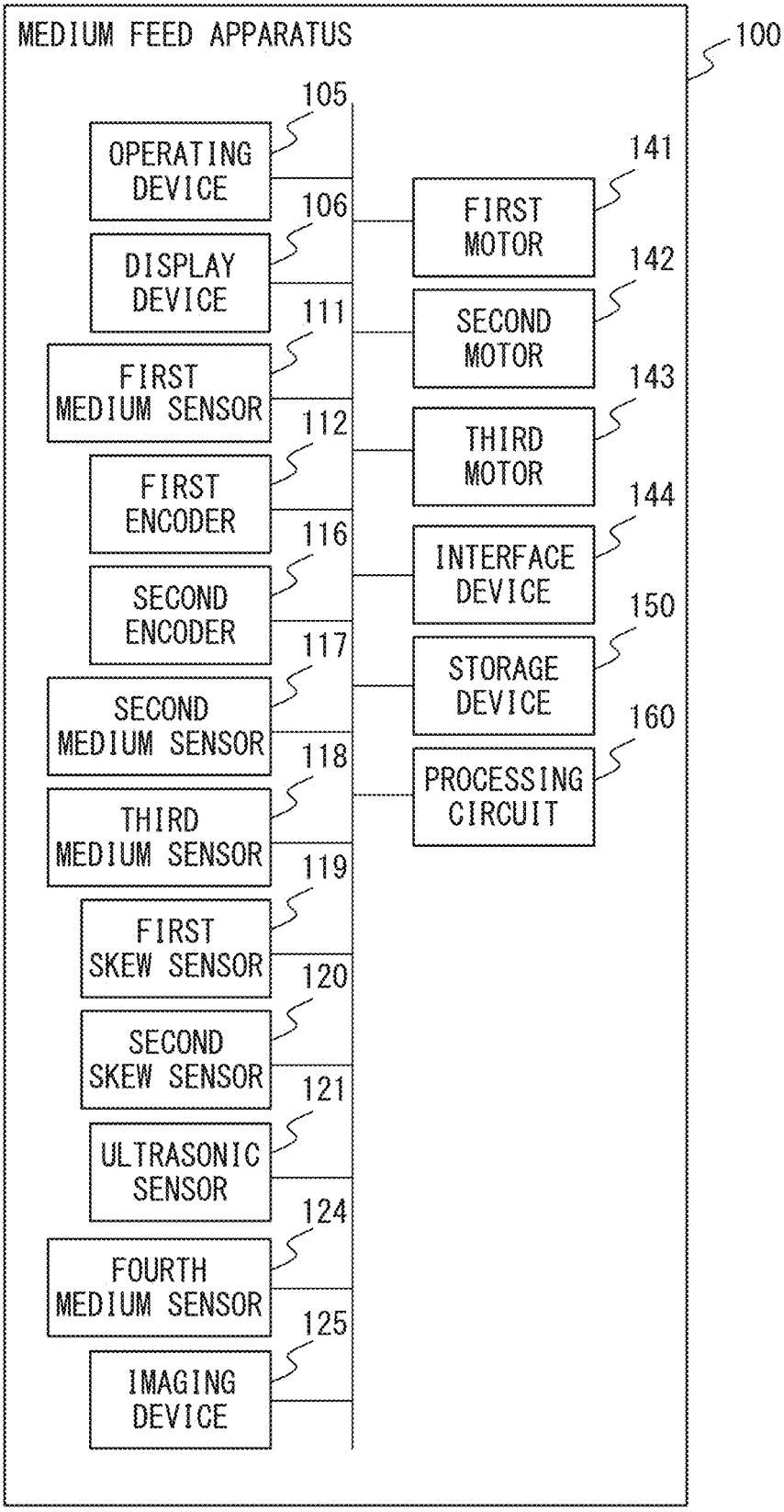
FIG. 5 is a block diagram illustrating a schematic constitution of an example of a medium feed apparatus.

FIG. 5 is a block diagram illustrating the schematic constitution of an example of a medium feed apparatus.

In addition to the above-mentioned constitution, the medium feed apparatus 100 further has a first motor 141, second motor 142, third motor 143, interface device 144, storage device 150, processing circuit 160, etc.

The first motor 141 includes one or more motors. It uses control signals from the processing circuit 160 to generate drive force for rotating the feed roller 114 in the medium feed direction A12 and feeding the medium. If a plurality of feed rollers 114 are provided, each feed roller 114 may be provided with a separate motor so that the feed rollers 114 independently rotate. Note that, the feed rollers 114 may be provided to rotate integrally by a common motor.

The second motor 142 is one example of a motor. The second motor 142 includes one or more motors. The second motor 142 uses control signals from the processing circuit 160 to generate drive force for rotating the separation roller 115 in the direction A13 opposite to the medium feed direction and separating the medium.

The third motor 143 includes one or more motors. It uses control signals from the processing circuit 160 to rotate the pick roller 113 and the first to sixth conveyance rollers 122*a* to 122*f* to convey the medium. Note that, the first to sixth driven rollers 123*a* to 123*f* may rotate with the drive force of the third motor 143 instead of being rotated by the first to sixth conveyance rollers 122*a* to 122*f*. Further, the third motor 143 uses control signals from the processing circuit 160 to move the stacking tray 103, swing the separation roller 115, or move the pick roller 113.

The interface device 144 has an interface circuit based on for example a Universal Serial Bus (USB) or other serial bus and is electrically coupled with an information processing apparatus (for example, a personal computer, mobile information terminal, etc.) to send and receive input images and various information. Further, instead of the interface device 144, a communication device having an antenna sending and receiving wireless signals and a wireless communication interface circuit for transmitting and receiving signals through a wireless communication line conforming to a predetermined communication protocol may be used. The predetermined communication protocol is, for example a wireless Local Area Network (LAN). The communication device may have a wired communication interface circuit for sending and receiving signals through a wired communication line conforming to a wired LAN or other communication protocol.

The storage device 160 has a Random Access Memory (RAM), Read Only Memory (ROM), or other memory device, hard disk or other fixed disk device, flexible disk, optical disk, or other portable storage device, etc. Further, the storage device 150 stores computer programs, databases, tables, etc., used for various processing of the medium feed apparatus 100. The computer programs may be installed on the storage device 140 from a computer-readable, non-transitory medium such as a Compact Disc ROM (CD-ROM), Digital Versatile Disc ROM (DVD-ROM), etc., by using a well-known setup program etc. The computer programs may be installed on the storage device 140 from a server, etc.

The processing circuit 160 operates based on programs stored in advance in the storage device 150. The processing circuit is, for example, a Central Processing Unit (CPU). As the processing circuit 160, a Digital Signal Processor (DSP), Large Scale Integrated Circuit (LSI), Application Specific Integrated Circuit (ASIC), Field-Programmable Gate Array (FPGA), etc., may be used.

The processing circuit 160 is coupled with the operating device 105, display device 106, first medium sensor 111, first encoder 112, second encoder 116, second medium sensor 117, third medium sensor 118, first skew sensor 119, second skew sensor 120, ultrasonic sensor 121, fourth medium sensor 124, imaging device 125, first motor 141, second motor 142, third motor 143, interface device 1444, storage device 150, etc., and control these parts. The processing circuit 160 controls the drive of the first motor 141, second motor 142, and third motor 143 and controls imaging by the imaging device 125, etc., based on the signals received from the sensors. The processing circuit 160 acquires input images from the imaging device 125 and sends the images to the information processing apparatus through the interface device 144.

Figure 6:
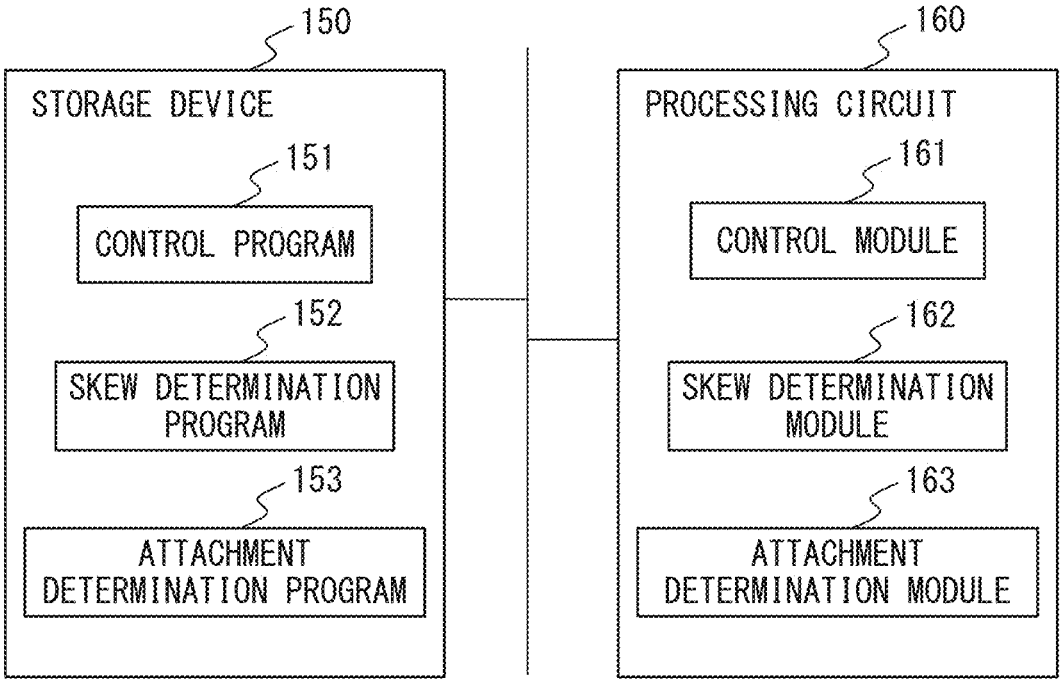
FIG. 6 is a view illustrating the schematic constitutions of an example of a storage device and an example of a processing circuit.

FIG. 6 is a view illustrating the schematic constitution of the storage device 150 and the processing circuit 160.

As illustrated in FIG. 6, the storage device 150 stores a control program 151, skew determination program 152, attachment determination program 153, etc. These programs are function modules loaded by software operating on a processor. The processing circuit 160 reads the programs stored in the storage device 150 and operates in accordance with the read programs. The processing circuit 160 functions as a control module 161, skew determination module 162, and attachment determination module 163.

Figure 7:
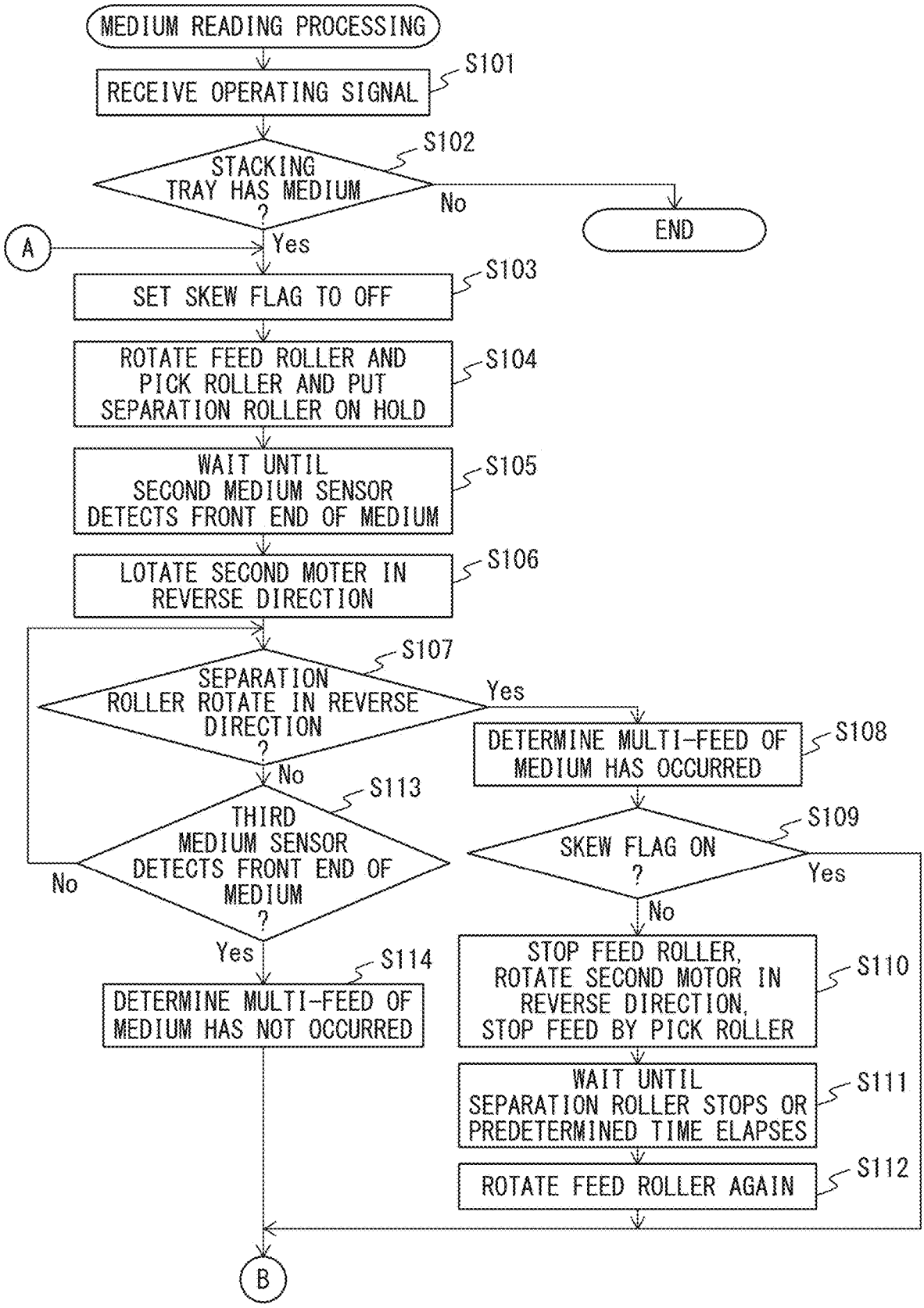
FIG. 7 is a flow chart presenting an example of operations in medium reading processing.
Figure 8:
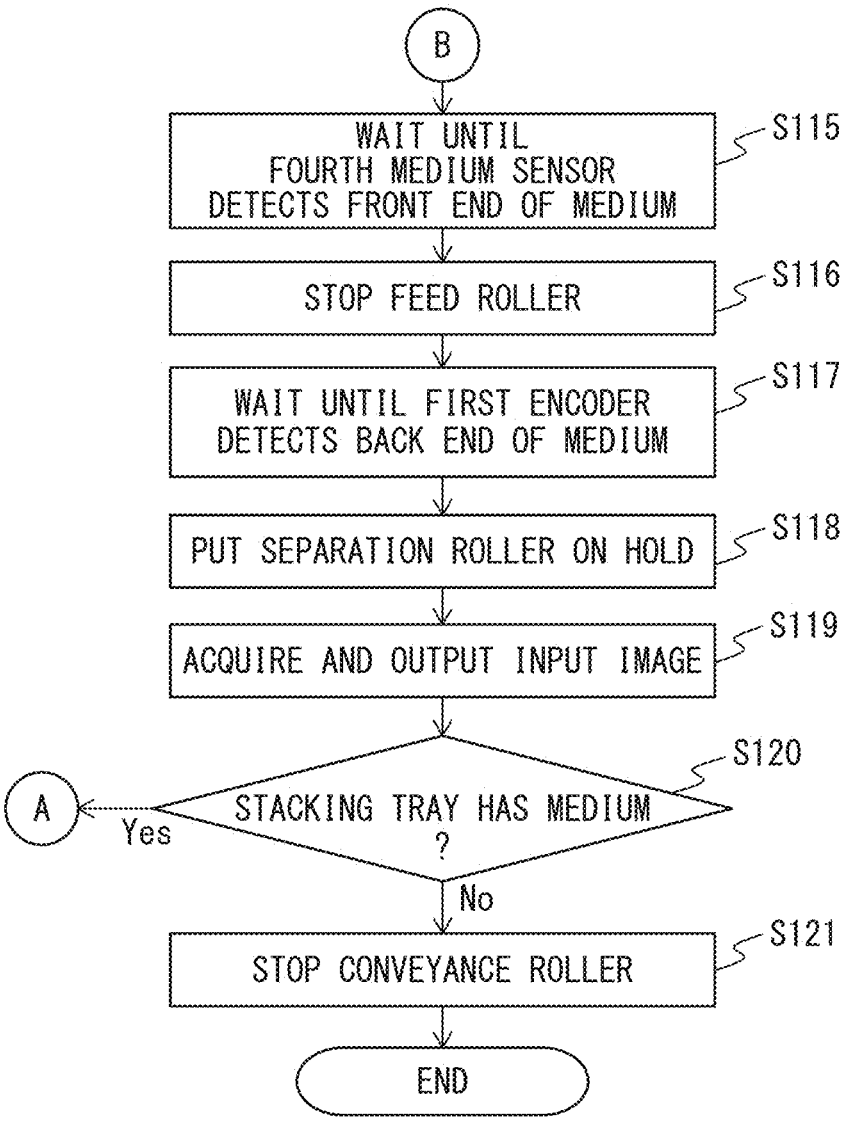
FIG. 8 is a flow chart presenting an example of operations in medium reading processing.

FIG. 7 and FIG. 8 are flow charts presenting an example of the operations in the medium reading processing of the medium feed apparatus 100.

An example of the operations in the medium reading processing of the medium feed apparatus 100 will be explained below in reference to the flow charts presented in FIG. 7 and FIG. 8. Note that, the flow of the operations explained below is performed, based on a program stored in advance in the storage device 150, mainly by the processing circuit 160 in cooperation with the elements of the medium feed apparatus 100. Note that, in this flow chart, the case where the feed mode is set to the separation mode will be explained.

First, the control module 161 waits until an instruction to read a medium is input by a user using the operating device 105 or an information processing apparatus and receiving an operating signal instructing reading of the medium from the operating device 105 or interface device 144 (step S101).

Next, the control module 161 acquires a medium signal from the first medium sensor 111 and determines whether the stacking tray 103 has the medium based on the acquired medium signal (step S102). If the stacking tray 103 does not have the medium, the control module 161 ends the series of processing.

If the stacking tray 103 has the medium, the control module 161 sets the skew flag to OFF (step S103). The skew flag is set to OFF each time the medium is fed and is set to ON when it is determined that skew of the medium has occurred in the later explained skew determination processing and the skew of the medium is corrected.

Next, the control module 161 drives the third motor 143 to move the stacking tray 103 to a position where the feed of the medium is enabled and to locate the pick roller 113 at the first position. The control module 161 drives the third motor 143 to rotate the pick roller 113 in the medium feed direction A11 and drives the first motor 141 to rotate the feed roller 114 in the medium feed direction A12 so as to the medium stacked on the stacking tray 103 to be fed. The control module 161 drives the third motor 143 to rotate the first to sixth conveyance rollers 122*a* to 122*f* such that the medium stacked on the stacking tray 103 is conveyed. Further, the control module 161 controls the second motor 142 to put the separation roller 115 on hold (step S104). The control module 161 powers the second motor 142 while controlling the separation roller 115 to put on hold (holding the stopped state).

Even if the separation roller 115 rotates in the direction A13 opposite to the medium feed direction right after starting feed of the medium, the medium waiting at the separation part is pushed out by the pick roller 113 and the feed roller 114 in the medium conveyance direction A2 and is pushed back by the separation roller 115. Due to this, the medium waiting at the separation part repeatedly moves forward and backward and the front end of the medium easily rises up causing buckling or jamming of the medium. Further, the separation roller 115 is given a force pushed downward by the pick roller 113 and the feed roller 114 through the medium waiting at the separation part. If the separation roller 115 rotatable in the direction A13 opposite to the medium feed direction supported by the arm 115*a* is given a rotational force in the direction A13 opposite to the medium feed direction, a downward moment will act on the separation roller 115 will be moved downward and the force pressing the separation roller 115 downward will increase. Due to this downward pressing force and upward biasing force by the biasing member through the arm 115*a*, the separation roller 115 vibrates in the height direction A1 and multi-feed of the medium (avalanching to downstream side of the separation part) more easily occurs. As opposed to this, the medium feed apparatus 100 can put the separation roller 115 on hold right after starting the feed of the medium to thereby keep jamming and multi-feed of the medium from occurring.

FIGS. 9A to 9C and FIGS. 10A to 10C are schematic views for explaining feed of a medium stacked on the stacking tray 103 with the front ends not aligned. FIGS. 9A to 9C and FIGS. 10A to 10C illustrate an example where a plurality of sheets of the medium are stacked on the stacking tray 103 so that a front end of the medium M2 placed at the bottom of the medium M1 placed at the top is positioned at the downstream side from a front end of the medium M1.

Figure 9A:
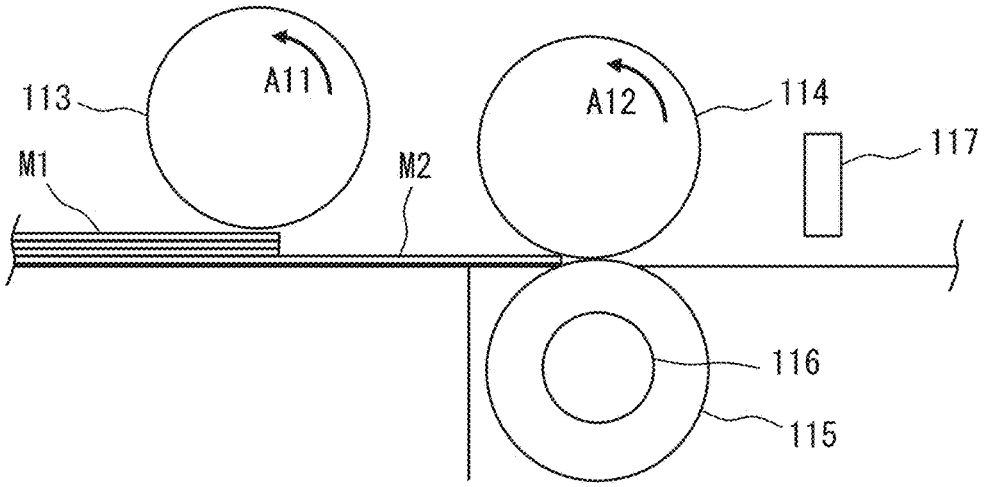
FIG. 9A is a schematic view for explaining feed of a medium.

FIG. 9A illustrates the states of the rollers right after starting feed of the medium. As illustrated in FIG. 9A, right after starting feed of the medium, the pick roller 113 and the feed roller 114 respectively rotate in the medium feed directions A11, A12 and the separation roller 115 is put on hold. Note that, as illustrated in FIG. 9A, if the plurality of sheets of the medium have not reached the separation part, the separation roller 115 is rotated in the medium feed direction A13' by the feed roller 114 because of the torque limiter provided at the separation roller 115. If the sheets of the medium have reached the separation part, the separation roller 115 is put on hold due to the control by the second motor 142.

Next, the control module 161 waits until the second medium sensor 117 detects a front end of the medium (step S105). The control module 161 periodically acquires a second medium signal from the second medium sensor 117. When the signal value of the second medium signal changes from a value indicating there is no medium to a value indicating there is the medium, the control module 161 determines that the second medium sensor 117 has detected a front end of the medium.

Next, the control module 161 controls the second motor 142 to generate a drive force for rotating the separation roller 115 in the direction A13 opposite to the medium feed direction so as to rotate the separation roller 115 in the direction A13 opposite to the medium feed direction (step S106). Below, sometimes the drive force for rotating the separation roller 115 in the direction A13 opposite to the medium feed direction will be referred to as the "separation drive force".

Figure 9B:
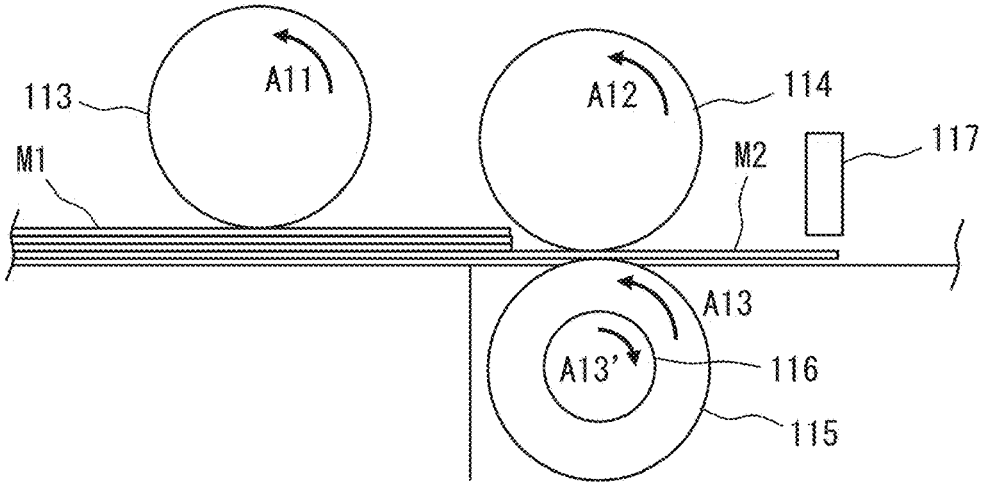
FIG. 9B is a schematic view for explaining feed of a medium.

FIG. 9B illustrates the state where the front end of the medium M2 placed at the bottom has passed the separation part. As illustrated in FIGS. 9A and 9B, because the feed roller 114 is in contact with the medium M2 placed under the medium M1, the medium M2 is fed by the feed roller 114 to the downstream side. When the front end of the medium M2 passes the separation part and the second medium sensor 117 detects the front end of the medium M2, the separation roller 115 is given a force rotating in the direction A13 opposite to the medium feed direction. However, due to the action of the torque limiter provided at the separation roller 115, the drive force from the second motor 142 is cut off. The separation roller 115 is not rotated by the drive force from the second motor 142, but the separation roller is rotated in the medium feed direction A13' by the feed roller 114.

Next, the control module 161 determines whether the separation roller 115 is rotating in the direction A13 opposite to the medium feed direction (step S107). The control module 161 periodically receives a rotation signal from the second encoder 116. The control module 161 determines whether the separation roller 115 is rotating in the direction A13 opposite to the medium feed direction by the direction of rotation indicated by the signal value of the received rotation signal.

The control module 161 may determine that the separation roller 115 is rotating in the direction A13 opposite to the medium feed direction so long as the distance of movement indicated by the signal value of the received rotation signal, i.e., the distance of movement of the outer circumferential surface of the separation roller 115, is a predetermined distance or more. In this case, the control module 161 determines that the separation roller 115 is rotating in the direction A13 opposite to the medium feed direction so long as the total of the distances of movement when the signal value of the rotation signal indicated the separation roller 115 is rotating in the direction A13 opposite to the medium feed direction is a predetermined distance or more. In this way, the control module 161 can keep multi-feed of the medium from being mistakenly determined when a slight slip causes the separation roller 115 to rotate in the direction A13 opposite to the medium feed direction.

Figure 9C:
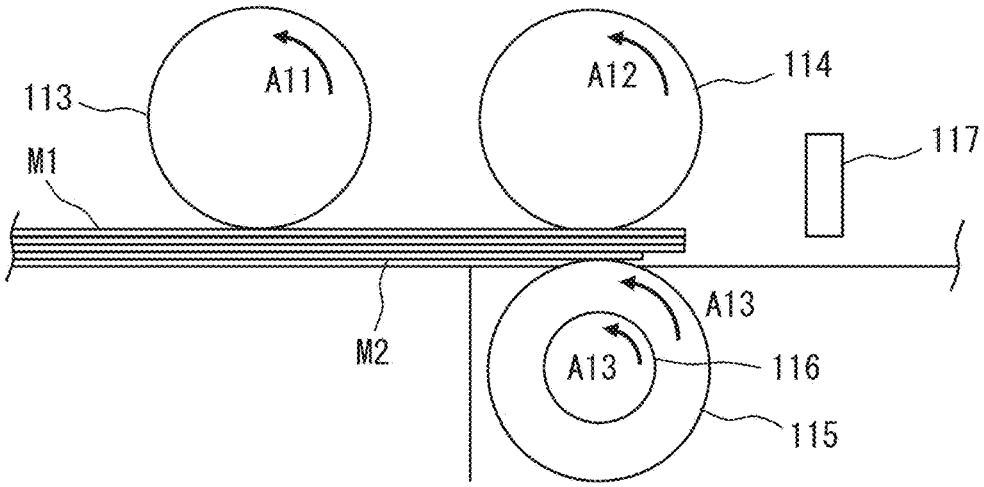
FIG. 9C is a schematic view for explaining feed of a medium.

FIG. 9C illustrates the state where the medium continues to be fed from the state illustrated in FIG. 9B. As illustrated in FIG. 9C, if the medium M2 placed at the bottom passes the separation part first, after that, the medium M1 placed at the top (and any medium placed between the medium M1 and the medium M2) will be fed by the pick roller 113 and the feed roller 114 and pass the separation part. When the medium M1 placed at the top passes the separation part, the separation roller 115 rotates in the direction A13 opposite to the medium feed direction by the separation drive force from the second motor 142 because there are a plurality of sheets of the medium between the feed roller 114 and the separation roller 115. Thus, the medium M2 contacting the separation roller 115 is pushed back to the upstream side.

If the separation roller 115 rotates in the direction A13 opposite to the medium feed direction, the control module 161 determines that multi-feed of the medium has occurred (step S108).

Next, the control module 161 determines whether the skew flag is ON (step S109). If the skew flag is ON, the control module 161 advances the processing to step S115 without performing the processing of steps S110 to S112. In other words, when the second encoder 116 detects rotation of the separation roller 115 in the direction A13 opposite to the medium feed direction during feed of the medium, the control module 161 does not stop the feed roller 114 if skew of the medium has occurred and the control module is correcting skew of the medium, i.e., performing skew correction. In this way, if skew of the medium has occurred, the control module 161 gives priority to skew correction of the medium. Therefore, the control module 161 can keep the medium from jamming and keep parts of an input image from being dropped due to the medium being conveyed at a slant.

If the skew flag is OFF, the control module 161 controls the first motor 141 to stop the feed roller 114. Further, the control module 161 controls the second motor 142 to generate a separation drive force to rotate the separation roller 115 in the direction A13 opposite to the medium feed direction. Furthermore, the control module 161 controls the third motor 143 to stop the feed of the medium by the pick roller 113 (step S110). For example, the control module 161 controls the third motor 143 to stop rotation of the pick roller 113 such that the feed of the medium by the pick roller 113 is stopped. Note that, the control module 161 may also control the third motor 143 to move the pick roller 113 from the first position to the second position such that the feed of the medium by the pick roller 113 is stopped. In this case, the pick roller 113 moves away from the medium and does not obstruct movement of the medium to the upstream side, so the medium feed apparatus 100 can return the medium to the upstream side better. In particular, if the medium being fed is thin paper, the medium feed apparatus 100 can keep the medium from jamming and being damaged.

In this way, if the second encoder 116 detects rotation of the separation roller 115 in the direction A13 opposite to the medium feed direction during feed of the medium, the control module 161 controls the second motor 142 to stop the feed roller 114 while generating a separation drive force. Further, if the second encoder 116 detects rotation of the separation roller 115 in the direction A13 opposite to the medium feed direction during feed of the medium, the control module 161 stop the pick roller 113. Alternatively, if the second encoder 116 detects rotation of the separation roller 115 in the direction A13 opposite to the medium feed direction during feed of the medium, the control module 161 further locates the pick roller 113 at the second position.

Figure 10A:
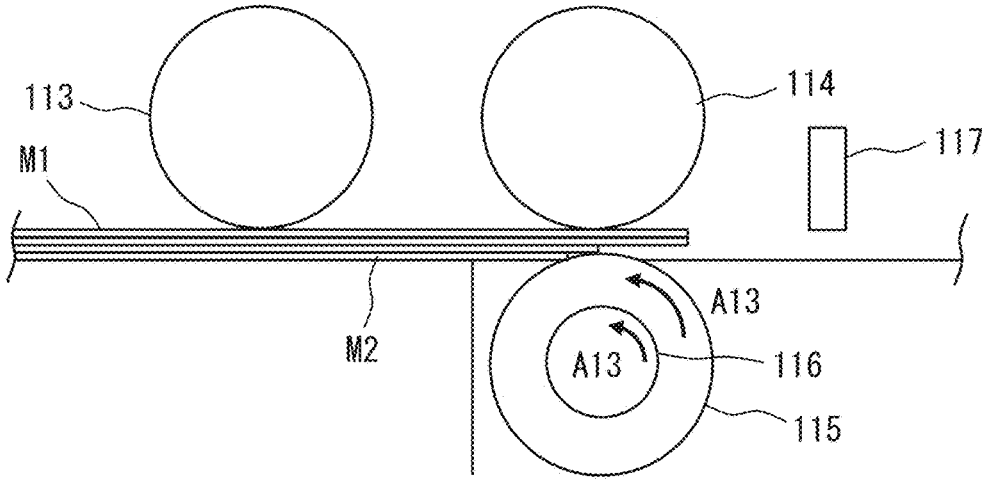
FIG. 10A is a schematic view for explaining feed of a medium.

FIG. 10A illustrates the state where the pick roller 113 and the feed roller 114 are stopped from the state illustrated in FIG. 9C. As illustrated in FIG. 10A, by stopping the pick roller 113 and the feed roller 114, the advancement of the medium M1 placed at the top side is stopped. On the other hand, the medium contacting the separation roller 115 is returned toward the upstream side by the separation roller 115 rotating in the direction A13 opposite to the medium feed direction. In other words, first, the medium M2 contacting the separation roller 115 is returned to the upstream side, the front end of the medium M2 is returned to the upstream side from the separation part, then the medium placed on the medium M2 is successively returned to the upstream side.

If trying to return the medium without stopping the pick roller 113 and the feed roller 114, there would be the possibility of several sheets of the medium being fed up to the position of the first conveyance roller 122*a* before returning all of the medium when a large number of sheets of the medium were fed to the downstream side from the separation part. Once the medium is gripped by the first conveyance roller 122*a* and the first driven roller 123*a*, the medium cannot be return to the upstream side. The medium feed apparatus 100 can reliably prevent the occurrence of multi-feed of the medium by stopping the pick roller 113 and the feed roller 114 until returning the medium other than that being fed to the upstream side from the separation part.

Note that, the control module 161 may stop the pick roller 113 or locate the pick roller 113 at the second position before the second encoder 116 detects rotation of the separation roller 115 in the direction A13 opposite to the medium feed direction during feed of the medium. In this case, the medium feed apparatus 100 can reliably prevent occurrence of multi-feed of the medium as well.

Next, the control module 161 waits until the second encoder 116 detects the separation roller 115 is stopped or until a predetermined time is elapsed from when the feed roller 114 is stopped (step S111). The predetermined time is set in advance by prior experiments to the time required for the separation roller 115 to rotate for returning the maximum number of sheets of the medium that may be multi-fed by the medium feed apparatus 100 to the upstream side from the separation part (for example, 10 seconds).

Figure 10B:
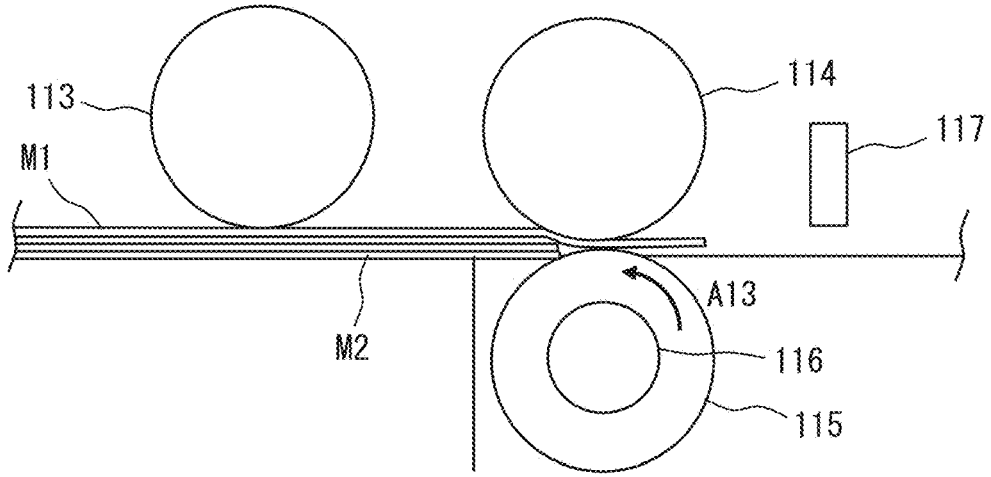
FIG. 10B is a schematic view for explaining feed of a medium.

FIG. 10B illustrates the state where the medium other than the medium to be fed returns to the upstream side from the separation part from the state illustrated in FIG. 10A. As illustrated in FIG. 10B, if all of the medium other than the medium M1 placed at the top returns to the upstream side from the separation part, only the medium M1 will remain between the feed roller 114 and the separation roller 115. Due to the action of the torque limiter provided at the separation roller 115, the drive force from the second motor 142 is cut off and the separation roller 115 is stopped by the stopped feed roller 114 without being rotated by the drive force from the second motor 142.

Next, the control module 161 drives the first motor 141 to rotate the feed roller 114 again in the medium feed direction A12 to feed the medium stacked on the stacking tray 103 again (step S112).

Figure 10C:
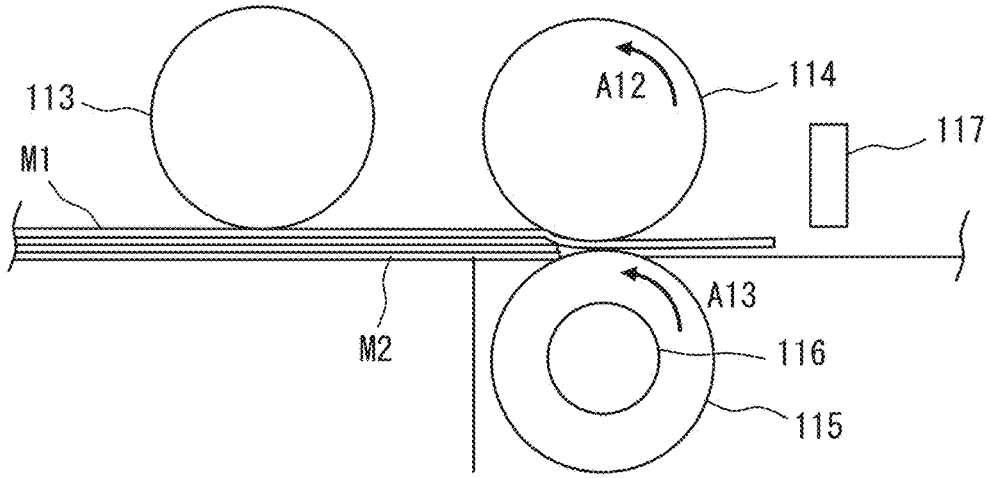
FIG. 10C is a schematic view for explaining feed of a medium.

FIG. 10C illustrates the state when the feed roller 114 is rotated again from the state illustrated in FIG. 10B. As illustrated in FIG. 10C, by rotating the feed roller 114 again, the sheet of the medium M1 placed at the top is again fed toward the downstream side and other sheets of the medium remain at the separation part due to the separation roller 115.

In this way, after stopping the feed roller 114, the control module 161 rotates the feed roller 114 again if the second encoder 116 detects the separation roller 115 is stopped. The control module 161 can use the second encoder 116 to monitor rotation of the separation roller 115 for immediately and reliably detecting the medium other than the medium to be fed are returned to the upstream side from the separation part. Therefore, the control module 161 can keep the medium from returning too much and jamming and can shorten the overall time for medium reading processing.

Further, after stopping the feed roller 114, the control module 161 rotates the feed roller 114 again if a predetermined time is elapsed. The control module 161 monitors for the elapse of the predetermined time from when the feed roller 114 is stopped such that the medium conveyance can continue processing suitably even when the surface of the separation roller 115 has be worn increasingly and the separation roller 115 cannot return the medium to the upstream side.

Note that, the control module 161 rotates the feed roller 114 again, but does not rotate the pick roller 113 again. The control module 161 rotates the pick roller 113 again at step S104 where feeding the sheet of the medium to be fed finished and feeding of the next sheet of the medium starts. Therefore, the control module 161 can reduce the conveyance force applied to the medium when again feeding the medium and keep multi-feed of the medium from reoccurring. Further, the control module 161 rotates the feed roller 114 again, but does not again place the pick roller 113 at the first position. The control module 161 again locates the pick roller 113 at the first position at step S104 where feeding of the sheet of the medium to be fed finished and feeding of the next sheet of the medium starts. Therefore, the control module 161 can reduce the frictional force applied between sheets of the medium when again feeding the medium and keep multi-feed of the medium from reoccurring.

Next, the control module 161 moves the processing to step S115 without returning to step S107. In other words, after the control module 161 rotates the feed roller 114 again, the control module 161 does not stop the feed roller 114 if the second encoder 116 again detects rotation of the separation roller 115 in the direction A13 opposite to the medium feed direction. Therefore, the medium feed apparatus 100 can prevent the medium being jammed and damaged caused by repeating advancement and retraction of the medium between the downstream side and upstream side of the separation part.

On the other hand, if the separation roller 115 did not rotate in the direction A13 opposite to the medium feed direction at step S107, the control module 161 determines whether the third medium sensor 118 has detected a front end of the medium (step S113). The control module 161 periodically acquires a third medium signal from the third medium sensor 118 and determines that the third medium sensor 118 has detected a front end of the medium when the signal value of the third medium signal changes from a value indicating the state where there is no medium to a value indicating the state where there is the medium. If the third medium sensor 118 has not detected a front end of the medium yet, the control module 161 returns the processing to step S107 and repeats the processing of step S107 and so on.

On the other hand, if the third medium sensor 118 has detected a front end of the medium, the control module 161 determines that multi-feed of the medium has not occur (step S114). In that case, the control module 161 subsequently advances the processing to step S115 without performing the processing of steps S110 to S112. In other words, the control module 161 stops the feed roller 114 if the second encoder 116 detects rotation of the separation roller 115 in the direction A13 opposite to the medium feed direction during feed of the medium so long as between the time from when the second medium sensor 117 detects a front end of the medium the time to when the third medium sensor 118 detects a front end of the medium. Therefore, since the medium is gripped by the first conveyance roller 122*a* and the first driven roller 123*a*, the medium will not return to upstream side, so the control module 161 can keep the medium from being damaged due to the medium being forcibly returned.

Next, the control module 161 waits until the fourth medium sensor 124 detects the front end of the medium (step S115). The control module 161 periodically acquires a fourth medium signal from the fourth medium sensor 124 and determines that the fourth medium sensor 124 has detected a front end of the medium when the signal value of the fourth medium signal changes from a value indicating a state where there is no medium to a value indicating a state where there is the medium.

Next, the control module 161 controls the first motor 141 to stop the feed roller 114 (step S116). After that, the medium is conveyed by the first conveyance roller 122*a* and the first driven roller 123*a*. By stopping the feed roller 114 after the medium passes the position of the first conveyance roller 122*a*, the control module 161 can keep the medium from being pushed out and bent by the feed roller 114 or from being pulled and damaged by the feed roller 114.

Next, the control module 161 waits until the first encoder 112 detects a back end of the medium (step S117). The control module 161 periodically acquires a distance signal from the first encoder 112 and determines that the first encoder 112 has detected a back end of the medium when the signal value of the distance signal changes from a value indicating the medium is moving to a value indicating the medium is not moving.

Next, the control module 161 controls the second motor 142 to put the separation roller 115 on hold (step S118).

As explained at steps S104 to S106, the control module 161 controls the second motor 142 to put the separation roller 115 on hold from when starting feed of the medium to when the second medium sensor 117 detects a front end of the medium. Further, the control module 161 controls the second motor 142 to generate a drive force for rotating the separation roller 115 in the direction A13 opposite to the medium feed direction from when the second medium sensor 117 detects a front end of the medium to when the first encoder 112 detects a back end of the medium. Therefore, the control module 161 can keep jamming of the medium and multi-feed from occurring right after starting feed of the medium while separating the medium during feed of the medium. Note that, the control module 161 may control the second motor 142 to put the separation roller 115 on hold at any timing after the first encoder 112 detects a back end of the medium such as when the second medium sensor 117 detects a back end of the medium.

Next, the control module 161 acquires an input image from the imaging device 125 and sends the acquired input image through the interface device 144 to the information processing apparatus for outputting the image (step S119). The control module 161 controls the imaging device 125 to start imaging before a front end of the medium reaches the imaging position of the imaging device 125, such as when the fourth medium sensor 124 detected a front end of the medium. Further, the control module 161 controls the imaging device 125 to finish imaging and acquires the input image from the imaging device 125 after a back end of the medium passes the imaging position of the imaging device 125, such as when a second predetermined time has been elapsed from when the fourth medium sensor 124 detected a back end of the medium. The second predetermined time is set to the time required for the medium to move from the fourth medium sensor 124 to the imaging position plus a certain margin.

Next, the control module 161 determines whether the stacking tray 103 has the remaining medium based on a medium signal received from the first medium sensor 111 (step S120). If the stacking tray 103 has the remaining medium, the control module 161 returns the processing to step S103 and repeats the processing of step S103 and so on.

On the other hand, if the stacking tray 103 does not have the medium, the control module 161 controls the third motor 143 to stop the first to sixth conveyance rollers 122*a* to 122*f* (step S121) and ends the series of steps.

If the feed mode is set to the nonseparation mode, the processing of steps S103, S105 to S114, and S120 are omitted. In this case, the control module 161 does not put the separation roller 115 on hold, but rotates the separation roller 115 by the feed roller 114.

Note that, the processing of steps S109 or S115 to S116 may be omitted.

Further, the control module 161 may receive a setting of whether to stop the feed roller 114 when multi-feed of the medium occurs from the user. In this case, the control module 161 receives settings inputted from the user via operating device 105 or the information processing apparatus from the operating device 105 or interface device 144 *a*. The control module 161 does not stop the feed roller 114 when set to not stopping the feed roller 114 at the time of multi-feed even if the separation roller 115 is rotating in the direction A13 opposite to the medium feed direction at step S107. When feeding a medium with too high frictional coefficient and difficult to separate, a medium bound by top gluing, a medium to which an attachment is adhered, etc., the user can set the feed roller 114 to not to stop when multi-feed of the medium occurs. Therefore, the medium feed apparatus 100 can keep a medium which is difficult to separate or a medium which should not be separated from being forcibly separated and damaged.

Further, the control module 161 may detect the set state of the medium at the stacking tray 103 and determine whether to stop the feed roller 114 at the time of occurrence of multi-feed based on the detected set state. In this case, for example, an imaging device capable of capturing a front end (downstream end) of the medium stacked on the stacking tray 103 is provided above the stacking tray 103. The control module 161 utilizes a known image processing technique to detect the magnitude of offset of the front ends of a plurality of sheets of the medium stacked on the stacking tray 103. If the detected magnitude of offset is a predetermined value (for example, 30 mm) or less, the control module 161 stops the feed roller 114 when multi-feed occurred. On the other hand, if the detected magnitude of offset is greater than the predetermined value, the control module 161 does not stop the feed roller 114 when multi-feed occurred but sends information indicating an alert through the interface device 144 to the information processing apparatus to thereby notify the user of the alert. The medium feed apparatus 100 can shorten the overall time taken for medium reading processing by not separating a medium requiring a long time for separation, but having the user reset it.

Further, if it is detected that the separation roller 115 is rotating in the direction A13 opposite to the medium feed direction at step S107, the control module 161 may change the pressing force of the separation roller 115 pressing the feed roller 114. For example, the control module 161 controls the third motor 143 to increase the pressing force of the separation roller 115 pressing the feed roller 114. In this way, the control module 161 can increase the frictional force generated between the medium fed by multi-feed and the separation roller 115 for returning the medium to the upstream side better.

Further, if the feed roller 114 is rotated again to feed the medium again at step S112, the control module 161 may change the pressing force of the separation roller 115 pressing the feed roller 114. For example, the control module 161 controls the third motor 143 to reduce the pressing force of the separation roller 115 pressing the feed roller 114. In this way, the control module 161 can increase the separation force by the feed roller 114 and separation roller 115 to prevent occurring multi-feed again.

Further, if the feed roller 114 is rotated again to feed the medium again at step S112, the control module 161 may change the peripheral speed of the feed roller 114. For example, the control module 161 controls the first motor 141 to lower (slow) the peripheral speed of the feed roller 114. In this way, the control module 161 can increase the performance of the feed roller 114 in separating the medium and keep multi-feed of the medium from occurring again.

Figure 11:
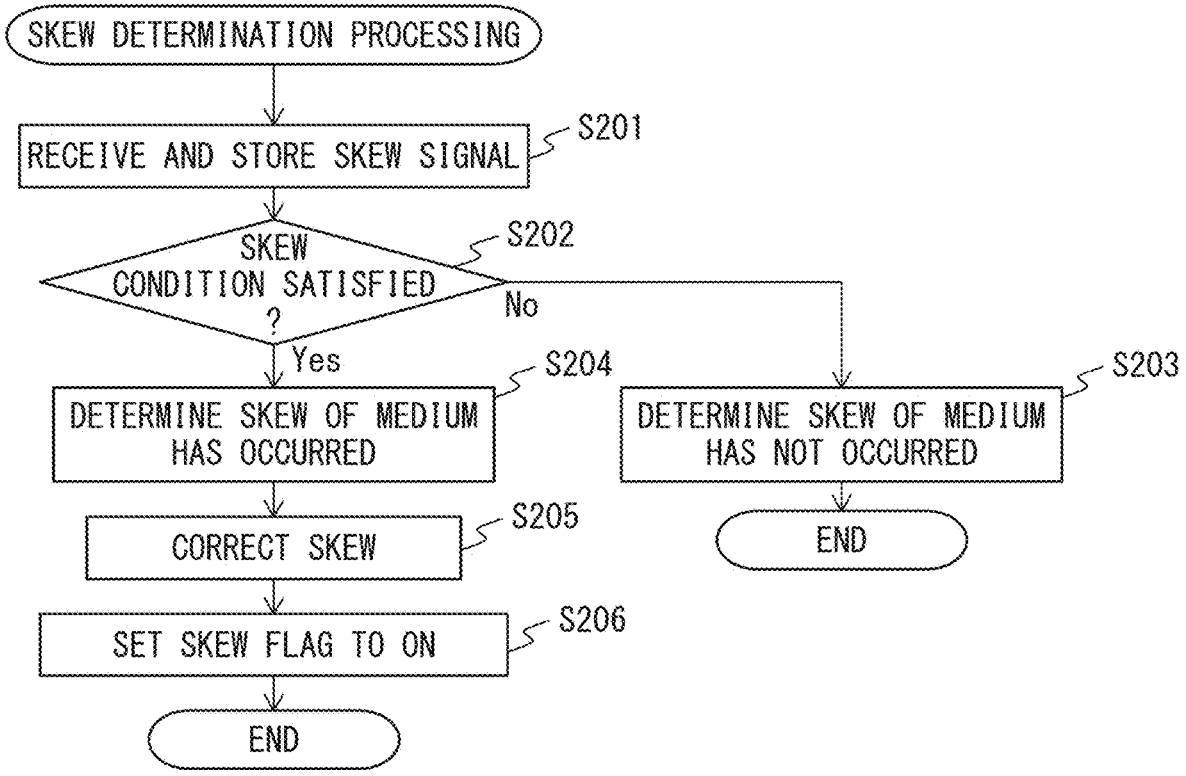
FIG. 11 is a flow chart presenting an example of operations in skew determination process.

FIG. 11 is a flow chart presenting an example of operations in skew determination process of the medium feed apparatus 100.

An example of operations in the skew determination process of the medium feed apparatus 100 will be explained below in reference to the flow chart presented in FIG. 11. Note that, the flow of operations explained below is performed, based on a program stored in advance in the storage device 150, mainly by the processing circuit 160 in cooperation with elements of the medium feed apparatus 100. The flow of operations presented in FIG. 11 is periodically performed while conveying the medium.

First, the skew determination module 162 receives the first skew signal and the second skew signal respectively from the first skew sensor 119 and the second skew sensor 120 and stores the signal values of the received skew signals in the storage device 150 (step S201).

Next, the skew determination module 162 determines whether a skew condition has been satisfied (step S202). The skew determination module 162 determines whether a front end of the medium has reached the positions of the first skew sensor 119 and the second skew sensor 120. The skew determination module 162 determines that a front end of the medium has reached the position of the first skew sensor 119 when the signal value of the first skew signal changes from a value indicating there is no medium to a value indicating there is the medium. Further, the skew determination module 162 determines that a front end of the medium has reached the position of the second skew sensor 120 when the signal value of the second skew signal changes from a value indicating there is no medium to a value indicating there is the medium. The skew determination module 162 determines that the skew condition has been satisfied if a front end of the medium reaches either one of the position of the first skew sensor 119 and the second skew sensor 120, and then does not reach the other position of the first skew sensor 119 and the second skew sensor 120 within a third predetermined time. The third predetermined time is set to the average value, center value, minimum value, maximum value, etc., of the difference in points of time when the medium passes the skew sensors when jamming of the medium occurs or dropping of parts of the input image in the medium occurs based on, for example, experiments performed in advance conveying the medium slanted.

If the skew condition has not been satisfied, the skew determination module 162 determines that skew of the medium has not occurred (step S203) and ends the series of steps. On the other hand, if the skew condition has satisfied, the skew determination module 162 determines that skew of the medium has occurred (step S204).

Next, if skew of the medium has occurred, the control module 161 controls a plurality of feed rollers 114 to correct the skew of the medium (step S205). The control module 161 corrects skew of the medium by setting the peripheral speed of each of the feed rollers 114 different from each other. The control module 161 changes the peripheral speeds of the feed rollers 114 such that the peripheral speed of the feed roller 114 located at the lagging side in the width direction A4 of the medium is faster (higher) than the peripheral speed of the feed roller 114 located at the preceding side. The control module 161 increases (raises) the peripheral speed of the feed roller 114 located at the lagging side of the medium and/or decreases (lowers) the peripheral speed of the feed roller 114 located at the preceding side.

Next, the skew determination module 162 sets the skew flag to ON (step S206) and ends the series of steps.

As explained at step S109 of FIG. 7, if the skew flag is ON, the control module 161 does not stop the feed roller 114 even if reverse rotation of the separation roller 115 (multi-feed of the medium) has occurred. Therefore, the control module 161 can suitably correct skew of the medium.

Figure 12:
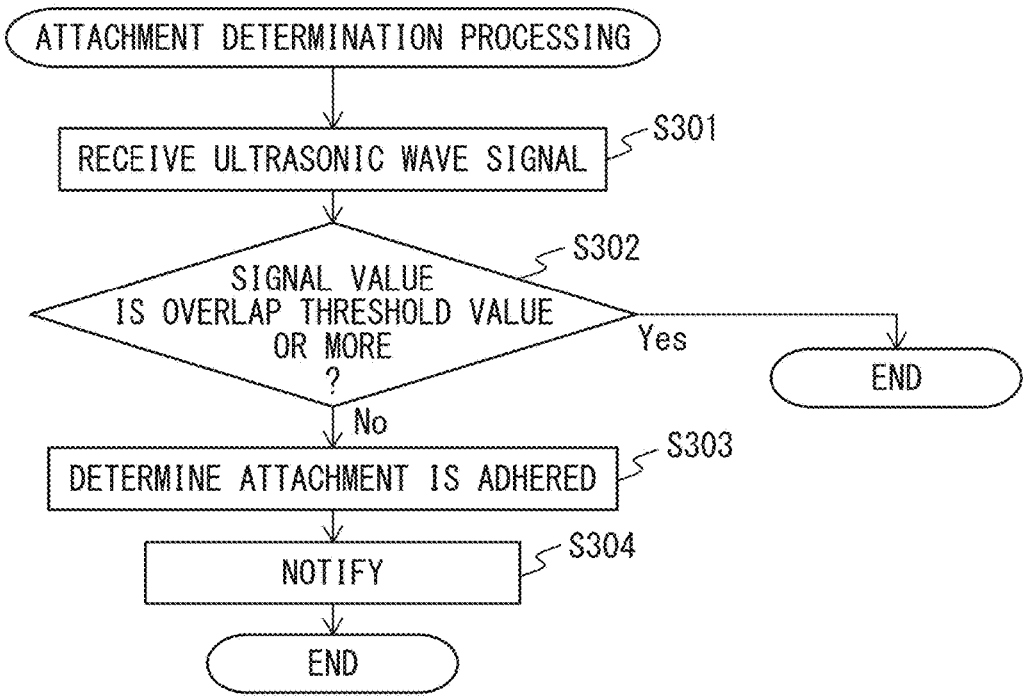
FIG. 12 is a flow chart presenting an example of operations in attachment determination process.

FIG. 12 is a flow chart presenting an example of operations in the attachment determination process of the medium feed apparatus 100.

An example of operations in the attachment determination process of the medium feed apparatus 100 will be explained below in reference to the flow chart presented in FIG. 12. Note that, the flow of operations explained below is performed, based on a program stored in advance in the storage device 150, mainly by the processing circuit 160 in cooperation with the elements of the medium feed apparatus 100. The flow of operations presented in FIG. 12 is performed periodically during conveyance of the medium.

First, the attachment determination module 163 acquires an ultrasonic wave signal from the ultrasonic sensor 121 (step S301). Next, the attachment determination module 163 determines whether the signal value of the acquired ultrasonic wave signal is an overlap threshold value or more (step S302). The overlap threshold value is set to a value between the signal value of the ultrasonic wave signal when one sheet of paper is conveyed and the signal value of the ultrasonic wave signal when multi-feed of the paper occurs.

If the signal value of the ultrasonic wave signal is the overlap threshold value or more, the attachment determination module 163 ends the series of steps without performing any particular processing. On the other hand, if the signal value of the ultrasonic wave signal is less than the overlap threshold value, the attachment determination module 163 determines that the medium has a sticker or label (seal) or other attachment (step S303). Next, the attachment determination module 163 sends information indicating that the medium has an attachment through the interface device 144 to the information processing apparatus for notifying the user of it (step S304) and ends the series of steps. On the other hand, the attachment determination module 163 determines that the medium does not have an attachment if the signal value of the ultrasonic wave signal does not become less than the overlap threshold value before a back end of the medium passes the ultrasonic sensor 121.

In this way, the attachment determination module 163 determines whether the medium has an attachment based on the ultrasonic wave signal. If, as explained above, multi-feed of the medium occurs, the separation roller 115 rotates in the direction A13 opposite to the medium feed direction and the control module 161 corrects the multi-feed of the medium. Therefore, if the ultrasonic sensor 121 located at the downstream side from the separation part detects overlap of the medium, the medium feed apparatus 100 can identify that it is not that multi-feed of the medium has occurred, but that the medium has an attachment.

As explained in detail above, the medium feed apparatus 100 puts the separation roller 115 on hold from when starting feed of the medium to when a front end of the medium passes the separation part. The medium feed apparatus 100 rotates the separation roller 115 backward after a front end of the medium passes the separation part while stopping the feed roller 114 if multi-feed of the medium has occurred. In this way, the medium feed apparatus 100 can keep jamming and multi-feed of the medium from occurring right after start of feed of the medium while separating well the medium during feed of the medium. Therefore, the medium feed apparatus 100 can more suitably feed the medium.

In particular, even when the front ends of sheets of the medium stacked on the stacking tray 103 by the user are not aligned, the medium feed apparatus 100 can keep jamming and multi-feed of the medium from occurring right after start of feed of the medium while separating well the medium during feed of the medium. The user no longer need to carefully align the medium when setting a plurality of sheets of the medium on the stacking tray 103. The medium feed apparatus 100 can therefore improve user friendliness.

Further, if multi-feed of the medium has occurred, the medium feed apparatus 100 does not rotate the pick roller 113 and the feed roller 114 backward to return all of the sheets of the medium together. Rather, the medium feed apparatus 100 does not rotate the pick roller 113 and the feed roller 114 backward, but rotates the separation roller 115 return the medium sheet by sheet. If sheets of the medium double fed in the state with their front ends not aligned are returned all together, the front ends of the returned sheets of the medium will remain unaligned in state, so the possibility of multi-feed occurring again at the time of resumption of feed is high. On the other hand, if the sheets of the medium double fed in the state with the front ends not aligned are returned one sheet at a time, the front ends of the returned sheets of the medium will be aligned just before the separation part, so the possibility of multi-feed occurring again at the time of resumption of feed will be low. If multi-feed of the medium occurs, the medium feed apparatus 100 can keep multi-feed of the medium from occurring again by returning the medium sheet by sheet by the separation roller 115.

Further, if multi-feed of the medium has occurred, the medium feed apparatus 100 does not rotate the pick roller 113 and the feed roller 114 backward, so there is no need to deactivate the one-way clutch restricting backward rotation of the pick roller 113 and the feed roller 114. Therefore, the medium feed apparatus 100 can simplify control by the control module 161 for returning the medium when multi-feed of the medium has occurred and can keep the development costs of the medium feed apparatus 100 from increasing. Further, the medium feed apparatus 100 can suppress slight movement of the pick roller 113 or the feed roller 114 caused by deactivation of the one-way clutch, as a result, the medium feed apparatus 100 can keep jamming of the medium from occurring.

Further, the medium feed apparatus 100 does not use an ultrasonic sensor or thickness sensor or the like, but uses the second encoder 116 for detecting rotation of the separation roller 115 to determine whether multi-feed of the medium has occurred. For this reason, even if a medium having an attachment is fed, the medium feed apparatus 100 will not mistakenly determine that multi-feed of the medium has occurred, so the medium feed apparatus 100 can determine if multi-feed of the medium has occurred with a high precision.

Figure 13:
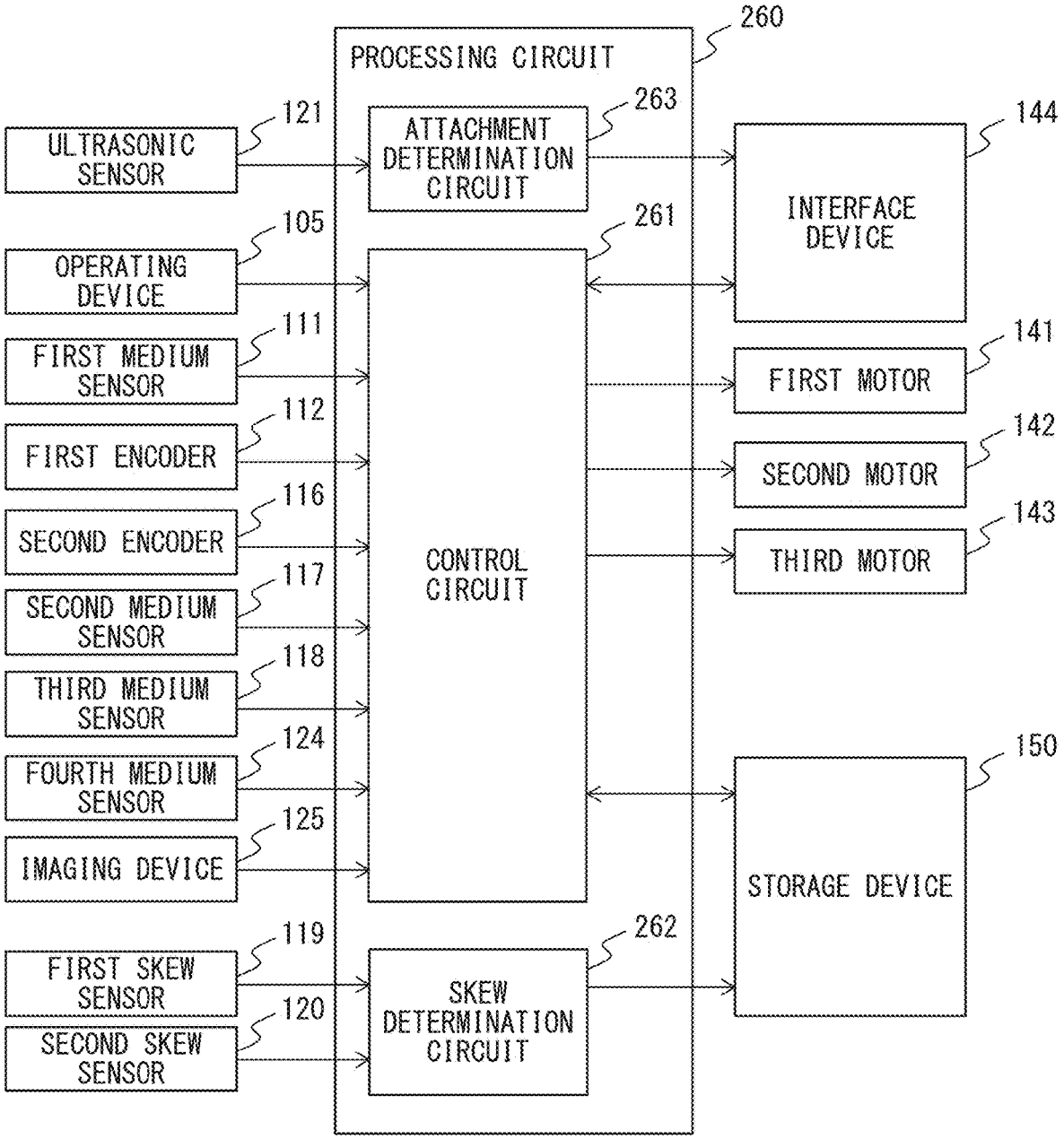
FIG. 13 is a view illustrating the schematic constitution of an example of a processing circuit according to another embodiment.

FIG. 13 is a view illustrating the schematic constitution of an example of a processing circuit 260 of the medium feed apparatus according to another embodiment.

The processing circuit 260 is used instead of the processing circuit 160 of the medium feed apparatus 100 and performs medium reading processing, etc., instead of the processing circuit 160. The processing circuit 260 has control circuit 261, skew determination circuit 262, attachment determination circuit 263, etc. Note that, these parts may be configured by respectively independent integrated circuits, microprocessors, firmware, etc.

The control circuit 261 is one example of a control module and has functions similar to the control module 161. The control circuit 261 receives operating signals from the operating device 105 or the interface device 144. Further, the control circuit 261 receives a first medium signal, second medium signal, third medium signal, and fourth medium signal respectively from the first medium sensor 111, second medium sensor 117, third medium sensor 118, and fourth medium sensor 124. Further, the control circuit 261 receives distance signals and rotation signals respectively from the first encoder 112 and the second encoder 116. Further, the control circuit 261 reads out the results of determination of skew from the storage device 150. The control circuit 261 controls the first motor 141, second motor 142, and third motor 143 based on the received signals and/or read out information. Further, the control circuit 261 acquires an input image from the imaging device 125 and outputs the input image to the interface device 144.

The skew determination circuit 262 is one example of a skew determination module and has functions similar to the skew determination module 162. The skew determination circuit 262 receives the first skew signal and the second skew signal from the first skew sensor 119 and the second skew sensor 120 respectively. The skew determination circuit 262 determines based on the received signals whether skew of the medium has occurred and stores the result of determination in the storage device 150.

The attachment determination circuit 263 is one example of an attachment determination module and has functions similar to the attachment determination module 163. The attachment determination circuit 263 receives an ultrasonic wave signal from the ultrasonic sensor 121. The attachment determination circuit 263 determines based on the received ultrasonic wave signal if the medium has an attachment and outputs an alert to the interface device 144 in accordance with the result of determination.

As explained in detail above, the medium feed apparatus can suitably feed a medium even if using the processing circuit 260.

Above, preferable embodiments are explained, but the embodiments are not limited to these. For example, the medium feed apparatus 100 may utilize another sensor instead of the second encoder 116 to detect multi-feed of the medium at the separation part. For example, the medium feed apparatus 100 uses an ultrasonic sensor to detect multi-feed of the medium at the separation part. In this case, an ultrasonic sensor similar to the ultrasonic sensor 121 is located at a position overlapping the nip part of the feed roller 114 and the separation roller 115 seen from the width direction A4. At step S107, the control module 161 receives an ultrasonic wave signal from the ultrasonic sensor and determines that multi-feed of the medium has occurred if the signal value of the received ultrasonic wave signal is less than an overlap threshold value.

Further, the medium feed apparatus 100 may detect multi-feed of the medium at the separation part based on the amount of current flowing to the second motor 142. In this case, as the second motor 142, a DC (direct current) motor is used. A DC motor is low cost and can be easily adjusted in speed, but the rotational speed of a DC motor changes depending on load fluctuations and other external factors. The more the rotational speed of the motor falls, the greater the torque of the motor becomes. The greater the torque of the motor becomes, the greater the amount of current that flows to the motor. At step S107, the control module 161 receives the amount of current flowing to the second motor 142 from the second motor 142 and, if the received amount of current is a current threshold value or more, determines that multi-feed of the medium has occurred. The current threshold value is set by prior experiments to the average value, center value, minimum value, or maximum value of the amount of current flowing to the DC motor when reverse rotation of the DC motor occurs.

Further, the medium feed apparatus 100 may utilize an optical sensor to detect multi-feed of the medium at the separation part. In this case, the optical sensor is located to capture the medium being fed from below at the region overlapping with the nip part of the feed roller 114 and separation roller 115 seen from the width direction A4. The optical sensor has a light emitter and light receiver provided at the same side with respect to the conveyance path of the medium and detects movement of the medium in the medium conveyance direction A2 and width direction A4. The light emitter is an LED, etc. and emits light toward the conveyance path. The light receiver captures images corresponding to the light received every constant time period and detects common parts from a latest image and immediately preceding image. The light receiver calculates the movement direction and movement speed of the conveyed medium based on changes in position of the detected common parts in the image and generates and outputs a movement signal indicating the calculated movement direction and movement speed. The "constant time period" is, for example, a time period corresponding to 100 operating pulses worth of the second motor 142. At step S107, the control module 161 receives the movement signal from the optical sensor and determines that multi-feed of the medium has occurred if the signal value of the received movement signal indicates that the medium is moving from the downstream side toward the upstream side.

Similarly, the medium feed apparatus 100 may utilize another sensor instead of the first encoder 112 to determine whether a back end of the medium has passed the position of the pick roller 113. For example, the medium feed apparatus 100 uses an optical sensor to determine whether a back end of the preceding sheet of the medium has passed the position of the pick roller 113. In this case, the above-mentioned optical sensor is located to capture the medium stacked on the stacking tray 103 from above the region overlapping with the nip part of the pick roller 113 seen from the width direction A4. At step S117, the control module 161 receives a movement signal from the optical sensor. If the signal value of the movement signal received does not indicate that the medium is moving from the upstream side toward the downstream side, it determines that a back end of the medium has passed the position of the pick roller 113.

Further, if using the second encoder 116 for detecting multi-feed of the medium, the medium feed apparatus 100 may utilize the second encoder 116 to perform functions other than determination of multi-feed of the medium. For example, the control module 161 controls the second motor 142 for rotating the separation roller 115 when starting up the medium feed apparatus 100 while acquiring a rotation signal from the second encoder 116. If the signal value of the rotation signal indicates that the separation roller 115 is not rotating, the control module 161 determines that the separation roller 115 has failed to be properly attached or has forgotten to be attached or that the separation roller 115 or the second encoder 116 is broken. Further, the control module 161 controls the first motor 141 to rotate the feed roller 114 when starting up the medium feed apparatus 100 while acquiring a rotation signal from the second encoder 116. If the signal value of the rotation signal indicates that the separation roller 115 is not rotating, the control module 161 determines that the surface of the feed roller 114 or separation roller 115 is dirty and the frictional force between the feed roller 114 and the separation roller 115 has decreased. In these cases, the control module 161 sends information indicating an alert through the interface device 144 to an information processing apparatus to notify the user of the alert.

Further, the control module 161 may also determine whether a succeeding sheet of the medium has reached the separation part based on the rotation signal from the second encoder 116 when a preceding sheet of the medium to be fed has passed the separation part. If the succeeding sheet of the medium has not reached the separation part while the preceding sheet of the medium is passing the separation part, the separation roller 115 rotates in the medium feed direction along with the feed roller 114. On the other hand, if the succeeding sheet of the medium reaches the separation part while the preceding sheet of the medium is passing the separation part, the separation roller 115 stops or rotates in the direction A13 opposite to the medium feed direction. Therefore, if the signal value of the rotation signal indicates that the separation roller 115 is rotating in the medium feed direction, the control module 161 determines that the succeeding sheet of the medium has not reached the separation part. On the other hand, if the signal value of the rotation signal indicates that the separation roller 115 has stopped or is rotating in the direction A13 opposite to the medium feed direction, the control module 161 determines that the succeeding sheet of the medium has reached the separation part. If the control module 161 determines that the succeeding sheet of the medium has reached the separation part when the preceding sheet of the medium to be fed has passed the separation part, for example, it delays the feed timings of the feed roller 114 and pick roller 113. Therefore, the control module 161 can sufficiently enlarge the distance between two sheets of the medium successively fed and keep sheets of the medium from striking each other or parts of the input images from being dropped.

According to the embodiment, the medium feed apparatus, medium feed method, and computer-readable, non-transitory medium can more suitably convey a medium.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a presentation of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium feed apparatus comprising:

a feed roller configured to feed a medium;

a separation roller located facing the feed roller;

a motor configured to generate a drive force for rotating the separation roller in an opposite direction to a medium feed direction;

a first sensor located at an upstream side from the feed roller and separation roller in a medium conveyance direction;

a second sensor located at a downstream side from the feed roller and separation roller in the medium conveyance direction;

a third sensor configured to detect rotation of the separation roller; and a processor to rotate the feed roller in the medium feed direction to feed the medium, wherein the processor controls the motor to put the separation roller on hold from when starting the feed of the medium to when the second sensor detects a front end of the medium and generate the drive force from when the second sensor detects the front end of the medium to when the first sensor detects a back end of the medium, and controls the motor to stop the feed roller while generating the drive force if the third sensor detects rotation of the separation roller in the opposite direction to the medium feed direction during feed of the medium.

2. The medium feed apparatus according to claim 1, wherein after the processor stops the feed roller, the processor rotates the feed roller again if the third sensor detects stopping of the separation roller.

3. The medium feed apparatus according to claim 1, wherein after the processor stops the feed roller, the processor rotates the feed roller again if a predetermined time period is elapsed.

4. The medium feed apparatus according to claim 2, wherein after the processor rotates the feed roller again, the processor does not stop the feed roller if the third sensor again detects rotation of the separation roller in the opposite direction to the medium feed direction.

5. The medium feed apparatus according to claim 1, further comprising a pick roller located at an upstream side from the feed roller and separation roller in the medium conveyance direction, wherein the processor further stops the pick roller if the third sensor detects rotation of the separation roller in the opposite direction to the medium feed direction during feed of the medium.

6. The medium feed apparatus according to claim 1, further comprising:

a stacking tray; and a pick roller located at an upstream side from the feed roller and separation roller in the medium conveyance direction and provided movably between a first position contacting the medium stacked on the stacking tray and a second position separated from the medium stacked on the stacking tray, wherein the processor locates the pick roller at the second position if the third sensor detects rotation of the separation roller in the opposite direction to the medium feed direction during feed of the medium.

7. The medium feed apparatus according to claim 1, further comprising:

a conveyance roller located at a downstream side from the feed roller and the separation roller in the medium conveyance direction; and a fourth sensor located between the feed roller and separation roller and the conveyance roller, wherein the processor stops the feed roller if the third sensor detects rotation of the separation roller in the opposite direction to the medium feed direction during feed of the medium so long as between when the second sensor detects the front end of the medium to when the fourth senor detects the front end of the medium.

8. The medium feed apparatus according to claim 1, wherein a plurality of the separation rollers are located spaced apart in a direction perpendicular to the medium conveyance direction, and the medium feed apparatus further comprises:

a first projecting part located between the plurality of separation rollers and provided swingably so as to project out from a guide surface of a medium; and a second projecting part located between the plurality of separation rollers and at a downstream side from the first projecting part in the medium conveyance direction and provided swingably so as to project out from the guide surface of a medium.

9. The medium feed apparatus according to claim 1, wherein a plurality of the feed rollers are located spaced apart in a direction perpendicular to the medium conveyance direction, wherein the processor determines whether skew has occurred, wherein the processor controls the plurality of feed rollers to correct the skew of the medium if skew of the medium has occurred, and when the third sensor detects rotation of the separation roller in the opposite direction to the medium feed direction during feed of the medium, the processor does not stop the feed rollers if skew correction is being performed.

10. A medium feed method comprising:

rotating a feed roller in a medium feed direction to feed a medium;

controlling a motor to put a separation roller located facing the feed roller on hold from when starting the feed of the medium to when a second sensor located at a downstream side from the feed roller and separation roller in a medium conveyance direction detects a front end of the medium and generate a drive force for rotating the separation roller in an opposite direction to the medium feed direction from when the second sensor detects the front end of the medium to when a first sensor located at an upstream side from the feed roller and separation roller in the medium conveyance direction detects a back end of the medium; and controlling the motor to stop the feed roller while generating the drive force if a third sensor detects rotation of the separation roller in the opposite direction to the medium feed direction during feed of the medium.

11. The method according to claim 10, further comprising, after the feed roller is stopped, rotating the feed roller again if the third sensor detects stopping of the separation roller.

12. The method according to claim 10, further comprising, after the feed roller is stopped, rotating the feed roller again if a predetermined time period is elapsed.

13. The method according to claim 11, wherein, after the feed roller is rotated again, the feed roller is not stopped if the third sensor again detects rotation of the separation roller in the opposite direction to the medium feed direction.

14. The method according to claim 10, further comprising stopping a pick roller located at an upstream side from the feed roller and separation roller in the medium conveyance direction if the third sensor detects rotation of the separation roller in the opposite direction to the medium feed direction during feed of the medium.

15. The method according to claim 10, further comprising locating a pick roller located at an upstream side from the feed roller and separation roller in the medium conveyance direction and provided movably between a first position contacting the medium stacked on a stacking tray and a second position separated from the medium stacked on the stacking tray at the second position if the third sensor detects rotation of the separation roller in the opposite direction to the medium feed direction during feed of the medium.

16. A computer-readable, non-transitory medium storing executable instructions for feeding a medium, the executable instructions comprising:

rotating a feed roller in a medium feed direction to feed the medium;

controlling a motor to put a separation roller located facing the feed roller on hold from when starting the feed of the medium to when a second sensor located at a downstream side from the feed roller and separation roller in a medium conveyance direction detects a front end of the medium and generate a drive force for rotating the separation roller in an opposite direction to the medium feed direction from when the second sensor detects the front end of the medium to when a first sensor located at an upstream side from the feed roller and separation roller in the medium conveyance direction detects a back end of the medium; and controlling the motor to stop the feed roller while generating the drive force if a third sensor detects rotation of the separation roller in the opposite direction to the medium feed direction during feed of the medium.

17. The computer-readable, non-transitory medium according to claim 16, the executable instructions further comprise, after the feed roller is stopped, rotating the feed roller again if the third sensor detects stopping of the separation roller.

18. The computer-readable, non-transitory medium according to claim 16, the executable instructions further comprise, after the feed roller is stopped, rotating the feed roller again if a predetermined time period is elapsed.

19. The computer-readable, non-transitory medium according to claim 17, wherein, after the feed roller is rotated again, the feed roller is not stopped if the third sensor again detects rotation of the separation roller in the opposite direction to the medium feed direction.

20. The computer-readable, non-transitory medium according to claim 16, the executable instructions further comprise stopping a pick roller located at an upstream side from the feed roller and separation roller in the medium conveyance direction if the third sensor detects rotation of the separation roller in the opposite direction to the medium feed direction during feed of the medium.

* * * * *